US009066843B1

(12) United States Patent
Greco

(10) Patent No.: US 9,066,843 B1
(45) Date of Patent: Jun. 30, 2015

(54) MASSAGE AND DILATING DEVICE

(71) Applicant: Darren J. Greco, Princeton, NJ (US)

(72) Inventor: Darren J. Greco, Princeton, NJ (US)

( * ) Notice: Subject to any disclaimer, the term of this patent is extended or adjusted under 35 U.S.C. 154(b) by 198 days.

(21) Appl. No.: 13/767,298

(22) Filed: Feb. 14, 2013

Related U.S. Application Data

(60) Provisional application No. 61/598,480, filed on Feb. 14, 2012, provisional application No. 61/715,878, filed on Oct. 19, 2012.

(51) Int. Cl.

| | |
|---|---|
| ***A61H 1/00*** | (2006.01) |
| ***A61H 15/00*** | (2006.01) |
| ***A61H 19/00*** | (2006.01) |
| ***A61H 21/00*** | (2006.01) |

(52) U.S. Cl.
CPC ..... *A61H 1/00* (2013.01); *A61H 19/44* (2013.01); *A61H 21/00* (2013.01)

(58) Field of Classification Search
CPC ..... A61H 19/00; A61H 19/40; A61H 19/44; A61H 21/00
USPC ..... 601/46, DIG. 16, 112, 118, 119
See application file for complete search history.

(56) References Cited

U.S. PATENT DOCUMENTS

| | | | | |
|---|---|---|---|---|
| 7,828,717 | B2 * | 11/2010 | Lee | 600/38 |
| 8,419,664 | B2 * | 4/2013 | Knyrim | 601/89 |
| 2005/0273024 | A1 * | 12/2005 | Nan | 601/71 |
| 2006/0141903 | A1 * | 6/2006 | Gardos et al. | 446/490 |
| 2009/0099413 | A1 * | 4/2009 | Kobashikawa et al. | 600/38 |

* cited by examiner

*Primary Examiner* — Kristen Matter
(74) *Attorney, Agent, or Firm* — Blank Rome LLP

(57) ABSTRACT

The invention relates to a device for the enlargement and/or stimulation and/or massaging of orifices of the body, such as the vagina or anus. The device is made up of a motor unit operatively engaged to a rotatable drive shaft, an insertion section located at the distal end of the massage device comprising a plurality of axially spaced drive cams rotationally coupled to the drive shaft, a control unit at the proximal end of the massage device for operating the drive shaft, and a flexible neck lying between the control unit and the insertion section to allow the user to adjust the positioning of the insertion section inside or immediately outside of the orifice being treated. In use the device is inserted into an orifice of the body and activated to adjust various functions of the device, such as varying the extent of expansion and contraction of the device, and adjusting the speed of vibration or rotation of the drive cams.

20 Claims, 46 Drawing Sheets

MASSAGE AND DILATING DEVICE

CROSS-REFERENCE TO RELATED APPLICATIONS

The present application relates to, and claims priority to U.S. Provisional Patent Application Ser. Nos. 61/598,480 filed on Feb. 14, 2012, which is entitled "Dilation Therapy Device" and 61/715,878 filed on Oct. 19, 2012, which is entitled "Dilator Device" The contents of these priority applications are incorporated herein in their entirety by reference.

TECHNICAL FIELD

This invention relates to devices for the enlargement and/or stimulation and/or massaging of orifices of the body, such as the vagina or anus. In particular, the invention relates to vaginal dilators. However, the invention is not to be construed as being limited thereto and could be used for other applications involving insertion of the device into an orifice of the body, such as in connection with sexual stimulation.

BACKGROUND

Vaginal dilators have been used for many years in medicine for a wide variety of applications including oncology, radiotherapy, gynecology, obstetrics and sex therapy. Vaginismus is gynecological condition involving involuntary contraction of the muscles surrounding the entrance to the vagina, making penetration impossible and/or painful. Vaginal agenesis is a birth defect or congenital disorder where sufferers have a short vagina (neo-vagina) or no vagina at all.

Treatment of these conditions may involve surgery followed by a period of vaginal training using dilators. Even in cases where surgery is not needed, medical dilators are used. There is also much post-operative need for dilation treatment. For example, vaginal or anal prolapse surgery treats a condition where parts of the bladder, uterus, and/or rectum protrude from the vagina or anus. This type of surgery is commonly followed up with dilation treatment.

For all of these conditions, vaginal dilation is a significant part of the treatment procedure and is likely to remain important for the remainder of the patient's life. In use, these dilators are typically inserted into the vaginal cavity for sessions of varying length, such as from about 10 minutes to about 1 hour, from one to several times daily, which eventually allows for the gradual enlargement of this orifice.

There are some vaginal dilators on the market, however, none currently provide an effective treatment which encourages expansion of the vaginal wall and the ability to manipulate various features of the device without having to switch out parts and/or manipulate the device while it has already been inserted into the orifice desired for treatment. Currently, dilator kits may be found on the market, which consist of a series of dilators of increasing length and diameter used in order to gradually expand the vaginal orifice. This type of product is undesirable because it comes with multiple parts which must be manipulated by the user.

For example, US 2007/0043388 discloses a kit comprising a series of dilators which are color coded because the difference in diameter from one dilator to the next may be small and hence not readily determined by sight or feel. This makes usage by the patient difficult, confusing and time consuming. Additionally, the user must choose which size of dilator to use and may not necessarily encourage stepping up to a larger size diameter even though the patient has grown accustomed to the smaller size, thus hindering progress of treatment. Furthermore, when these dilators are inserted into the vagina, there is no expansion or retraction movement of the device which may encourage slow gradual expansion of the vaginal wall.

Balloon dilators are also sold in the market, however these types of dilators are associated with many drawbacks. For example, because of their inflatable nature, these products are not able to achieve a true uniformity of diameter along the length of the device. Any expansion or retraction provided by these types of devices is not easy to control by the user. Also, these types of dilators cannot be subjected to heat and therefore do not encourage optimized conditions for the patient who may desire or require a heated device for insertion into the orifice to be treated.

There is therefore a need for a dilator device which incorporates a variety of different sizes of diameters in a single device which can be uniformly expanded and contracted along the length of the device, according to the patient's preferences or physician's recommendations. Furthermore, there is a need for a single device which does not require several parts which must be switched out by the patient during treatment in order to facilitate adjustment of the device. There is also a need for a dilator device which encourages gradual expansion of the internal orifice tissues by creating a warm or heated environment when the device is in use.

SUMMARY

In one general aspect there is provided a device that is made up of a motor unit operatively engaged to a rotatable drive shaft, an insertion section located at the distal end of the device comprising a plurality of axially spaced drive cams rotationally coupled to the drive shaft, a control unit at the proximal end of the massage device for operating the drive shaft, and a flexible neck lying between the control unit and the insertion section.

Embodiments of the device may include one or more of the following features. For example, the device may include drive cams that rotate in response to the rotation of the drive shaft. The control unit may be operative for adjusting the extent of expansion and contraction of the device. The control unit may be operative for changing speeds of rotation of the drive shaft and vibration independently in response to separate operator-controlled elements.

The device may include a plurality of outer rings supported by a generally cylindrical housing which houses the drive cams and drive shaft, the housing having a plurality of ports designed to mate with the plurality of outer rings. The device may function such that at least one outer ring is moved radially in response to a force exerted by at least one drive cam as the drive cam rotates in response to the rotation of the drive shaft.

A plurality of outer rings may be moved radially in response to a force exerted by a plurality of drive cams as the drive cams rotate in response to the rotation of the drive shaft.

The device may include a flexible neck having a proximal end and a distal end with the proximal end being in connection with the the control unit and the distal end being in connection with the insertion section. The motor unit of the device may be housed within the control unit. The device may also include a heating element.

In another general aspect there is provided a method of treating an orifice of the body. The method includes:

providing a therapeutic device including a motor unit operatively engaged to a rotatable drive shaft, an insertion section located at the distal end of the device having a plurality of axially spaced drive cams rotationally coupled to the drive shaft, a control unit at the proximal end of the device for operating the drive shaft, and a flexible neck lying between the control unit and the insertion section;

inserting the device into the orifice of the body; and, activating the device to adjust the extent of expansion and contraction of the device.

Embodiments of the method may include one or more of the following features. For example, the drive cams may rotate in response to the rotation of the drive shaft. The method may include a further step of adjusting the position of the insertion section inside or immediately outside of the orifice being treated using the flexible neck.

The control unit may be operative for changing speeds of rotation of the drive shaft and vibration independently in response to separate operator-controlled elements.

The device may include a plurality of outer rings supported by a generally cylindrical housing which houses the drive cams and drive shaft, the housing having a plurality of ports designed to mate with the plurality of outer rings. The device may include at least one outer ring which is moved radially in response to a force exerted by at least one drive cam as the drive cam rotates in response to the rotation of the drive shaft. The device may function such that a plurality of outer rings are moved radially in response to a force exerted by a plurality of drive cams as the drive cams rotate in response to the rotation of the drive shaft.

The flexible neck of the device may have a proximal end and a distal end, the proximal end being in connection with the the control unit and the distal end being in connection with the insertion section. The motor unit of the device may be housed within the control unit. The therapeutic device may further include a heating element.

DETAILED DESCRIPTION

Figure 1:
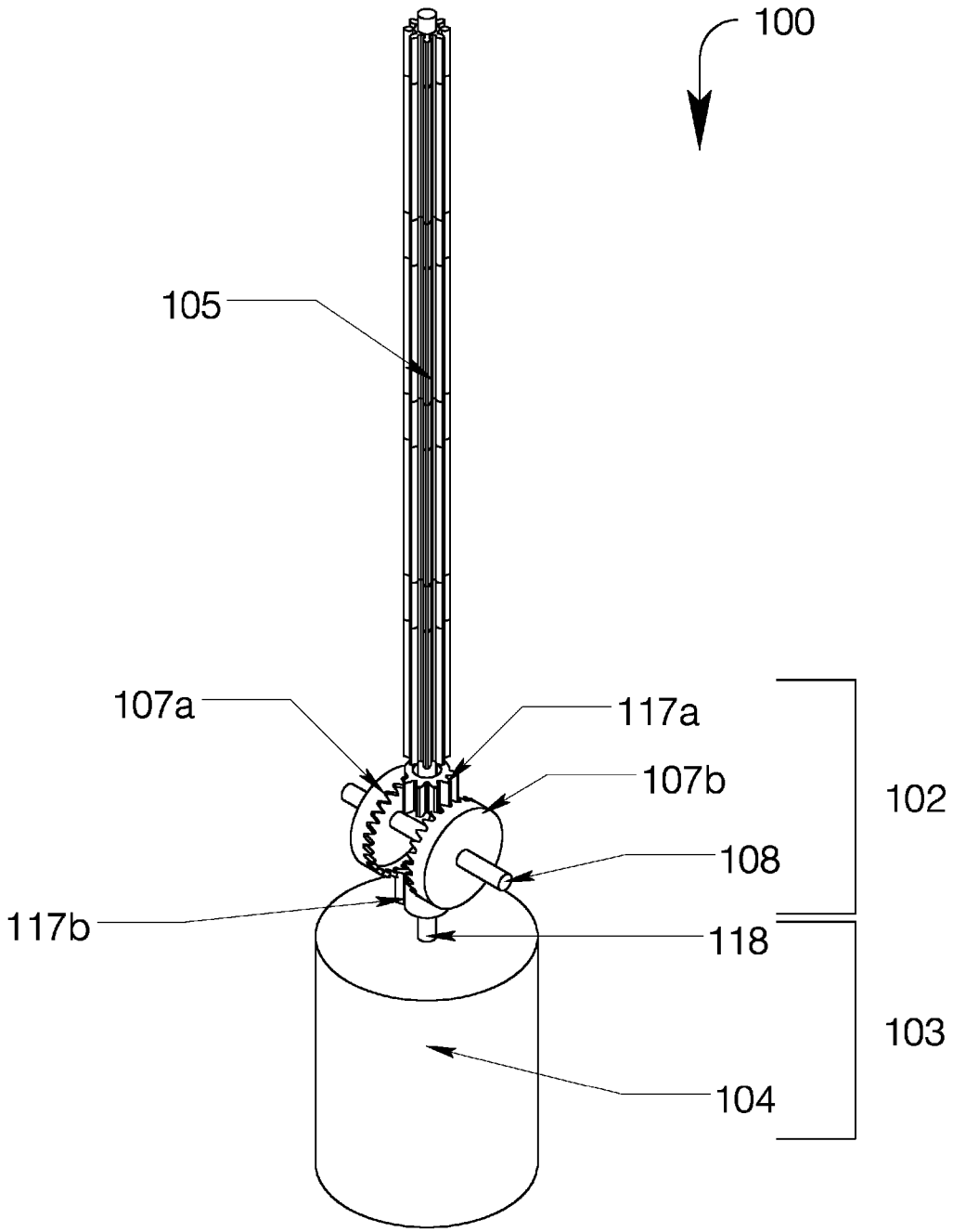
FIGS. 1 and 2 are a perspective view and side view, respectively, of the central drive axis of the dilator device.
Figure 2:
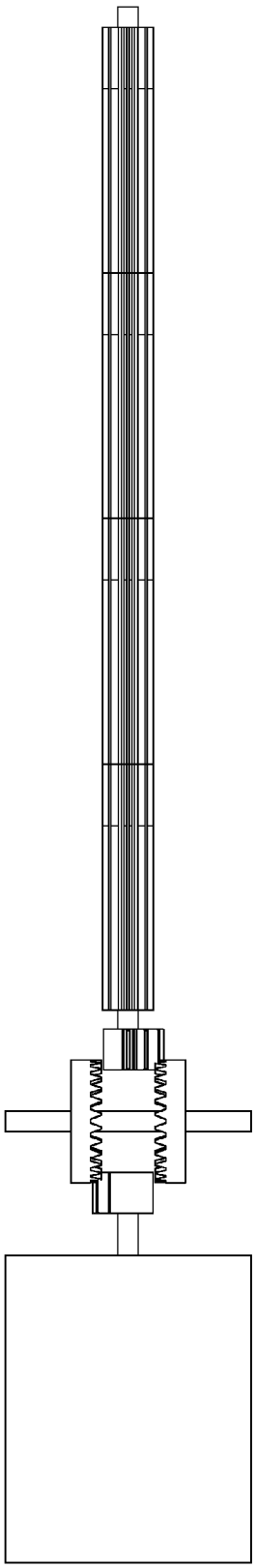

FIGS. 1 and 2 are partial views of the internal mechanism for dilator device 100. The dilator device in FIGS. 1 and 2 show the central drive axis comprising an alternating differential assembly 102, and an AC or DC motor 103 contained in a motor housing 104. The central drive axis is comprised of a dilator arm drive pinion 105 in connection with the alternating differential assembly 102. The dilator arm drive pinion 105 is a long, small diameter, round gear having teeth along its outer surface. The alternating differential assembly 102 comprises a first alternating spur gear 117*a* which is mounted to drive pinion 105, a second alternating spur gear 117*b* which is mounted to the motor shaft 118, and crown gears 107*a* and 107*b*, the crown gears being oriented perpendicular to the spur gears 117*a* and *b*. The dilator arm drive pinion 105 also rotates perpendicular to the crown gears 107*a* and 107*b*. The crown gears 107*a* and 107*b* are mounted onto crown gear mounting shaft 108. When the motor 103 is turned on, the second alternating spur gear begins to rotate, which rotates crown gears 107*a* and *b*. The rotation of crown gears 107*a* and *b* rotates the first alternating spur gear 117*a*, which is mounted to the dilator arm drive pinion 105 and in turn causes the dilator arm drive pinion to rotate. The alternating differential assembly may be driven by motor 103 in either a clock-wise or counter clock-wise direction, and therefore the dilator arm drive pinion 105 may be rotated in either direction, as well.

Of particular importance is the nature and purpose of the alternating spur gear arrangement which functions primarily such that the motor may continue in one continuous direction, but when a predetermined limit of travel of the spur gears is reached, the motion of the spur gears is reversed so that the device does not expand beyond the predetermined limit. In this way, the alternating spur gear arrangement acts as a safety without the user having to manipulate the device in order to reverse the direction of the motor once a predetermined maximum expansion has been reached.

Figure 3:
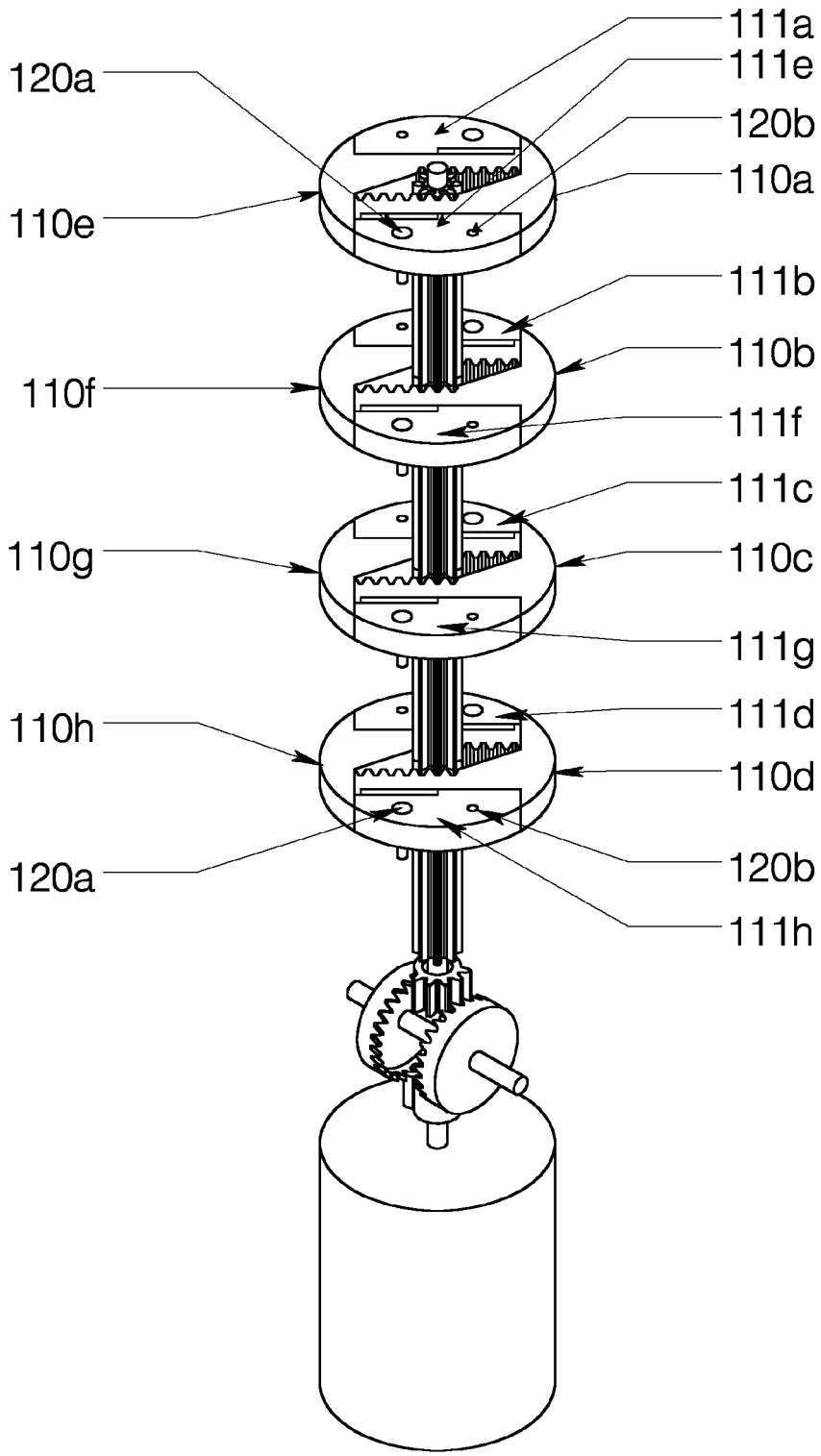
FIGS. 3 and 4 are a perspective view and side view, respectively, of the central drive axis having four dilator arms and four arm base tracks in a retracted position.
Figure 4:
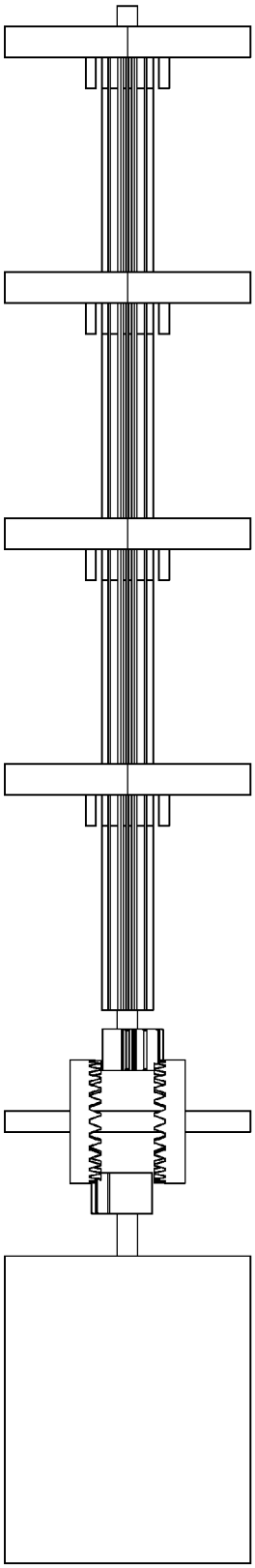
Figure 5:
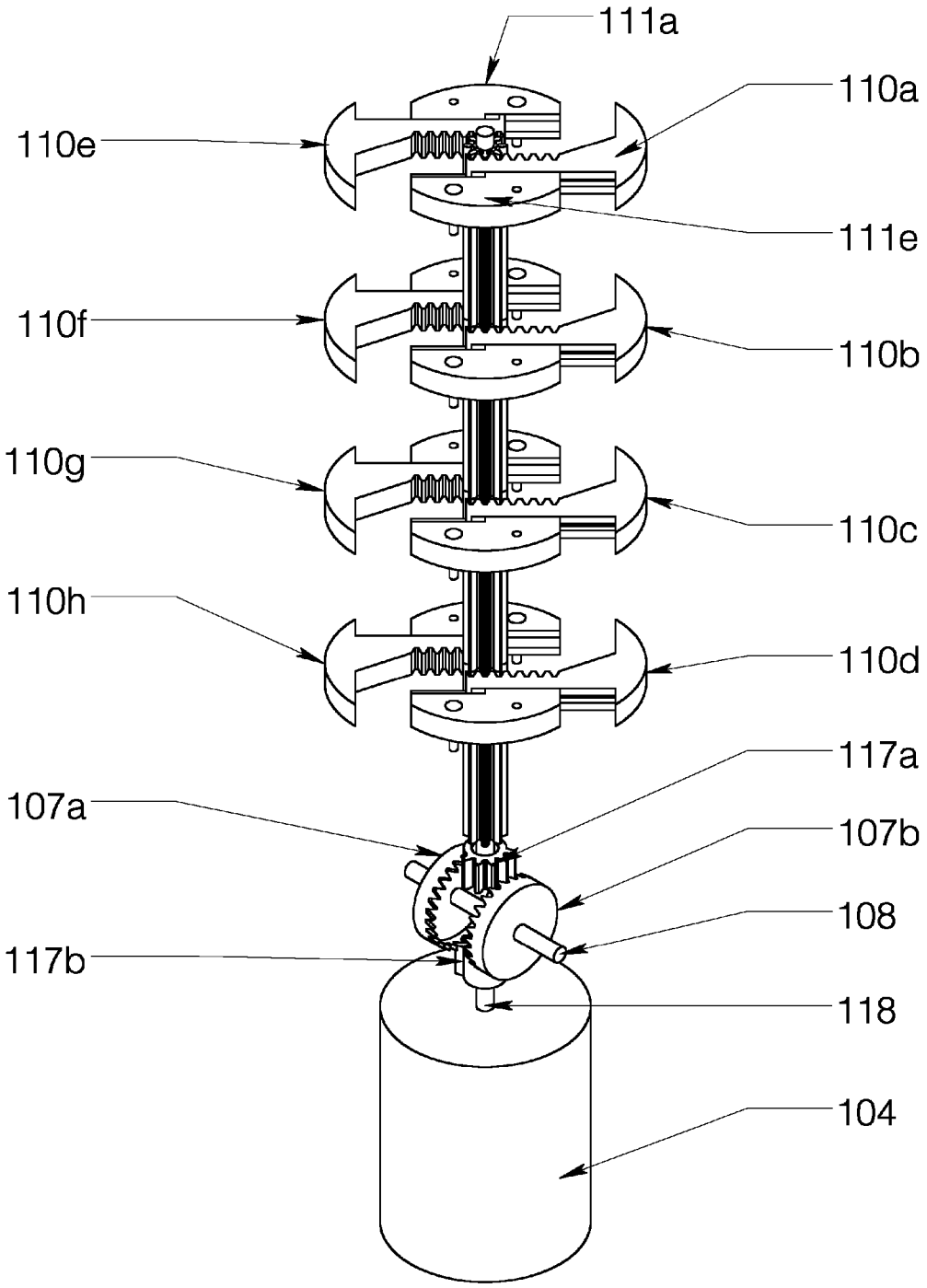
FIGS. 5 and 6 are a perspective view and side view, respectively, of the central drive axis having four dilator arms and four arm base tracks in a dilated position.
Figure 6:
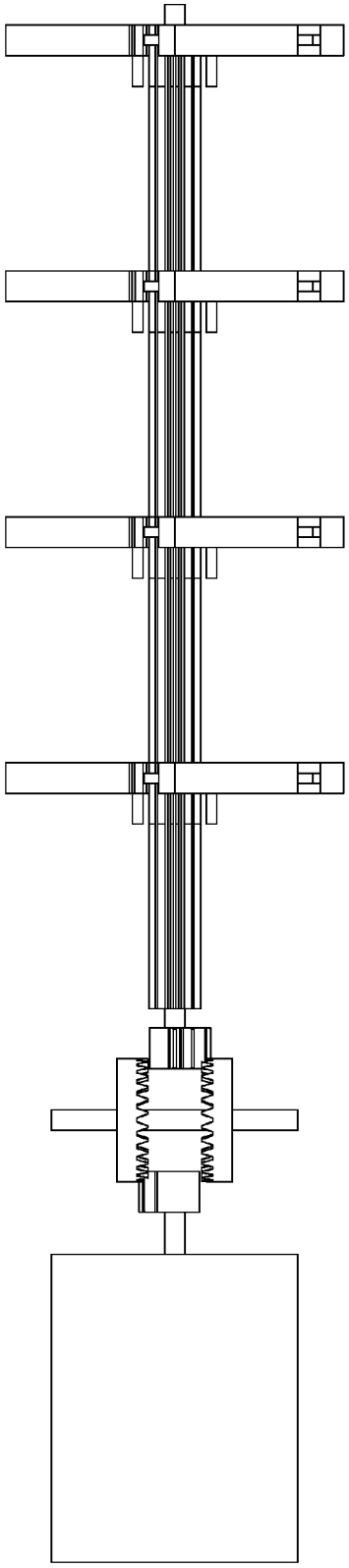
Figure 7:
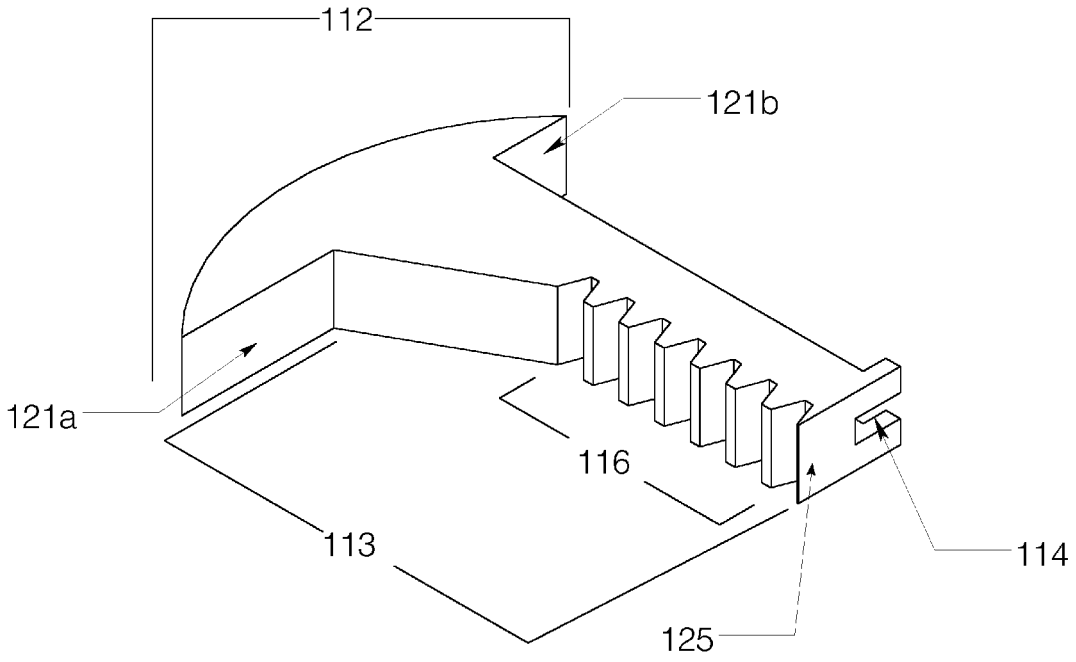
FIGS. 7 and 8 are perspective views of a dilator arm of the present invention.
Figure 8:
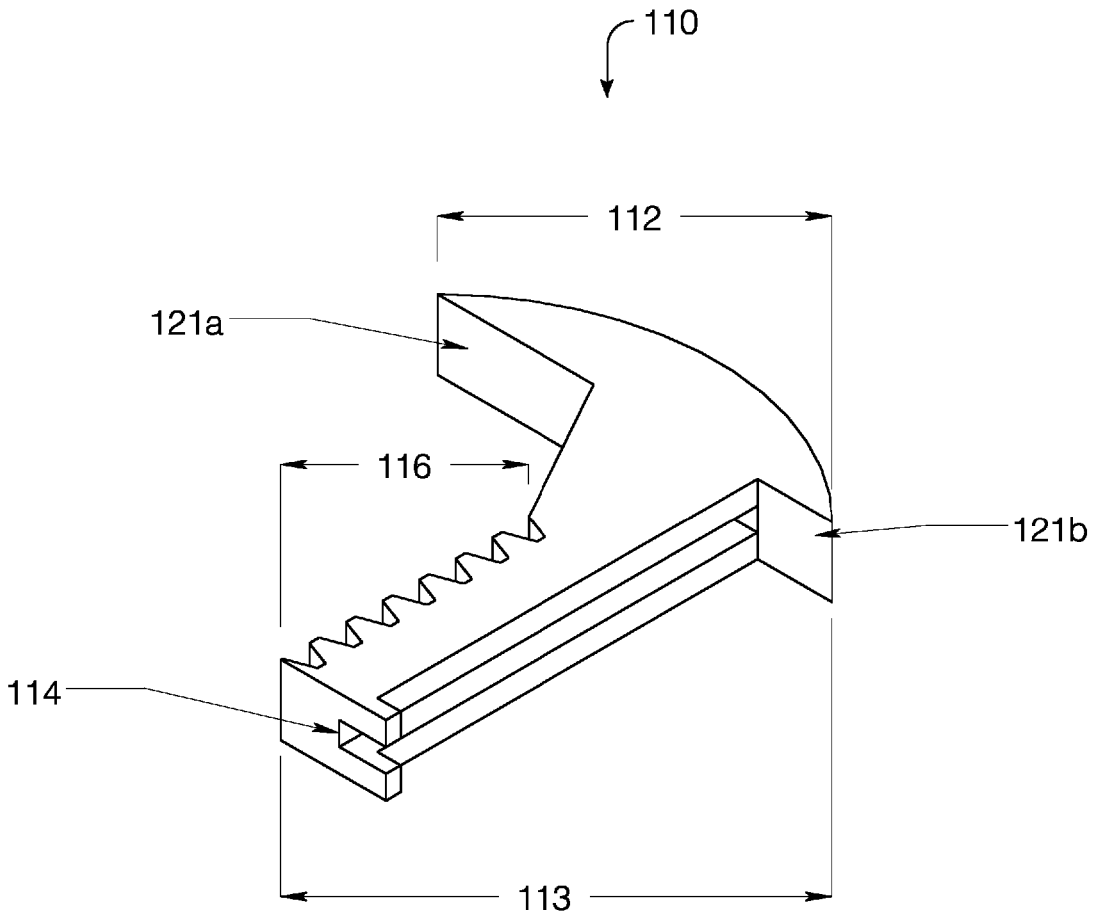
Figure 9:
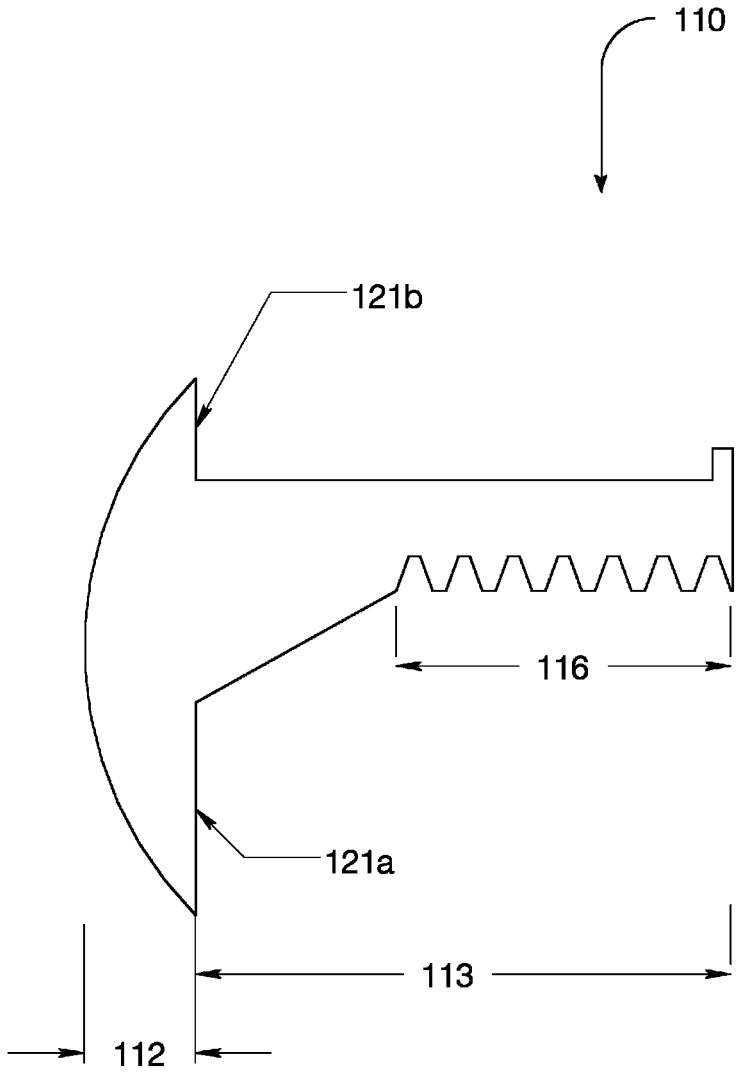
FIG. 9 is a side view of a dilator arm of the present invention.
Figure 10:
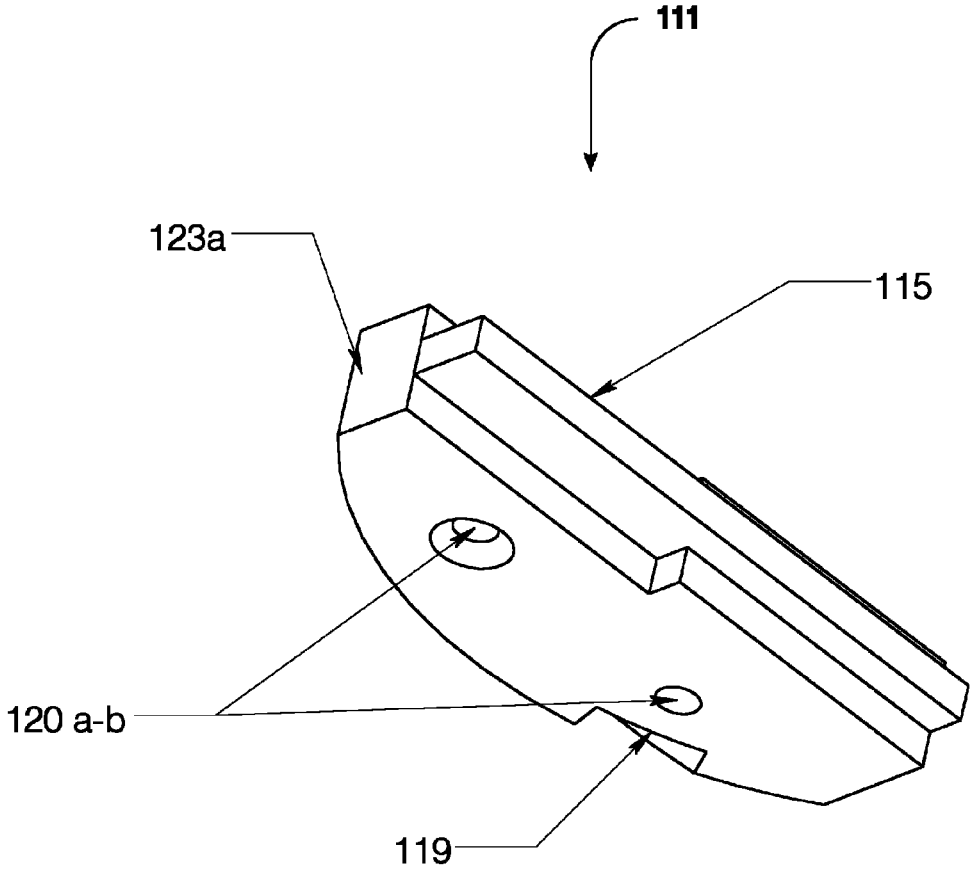
FIGS. 10 and 11 are perspective views of an arm base track of the present invention.
Figure 11:
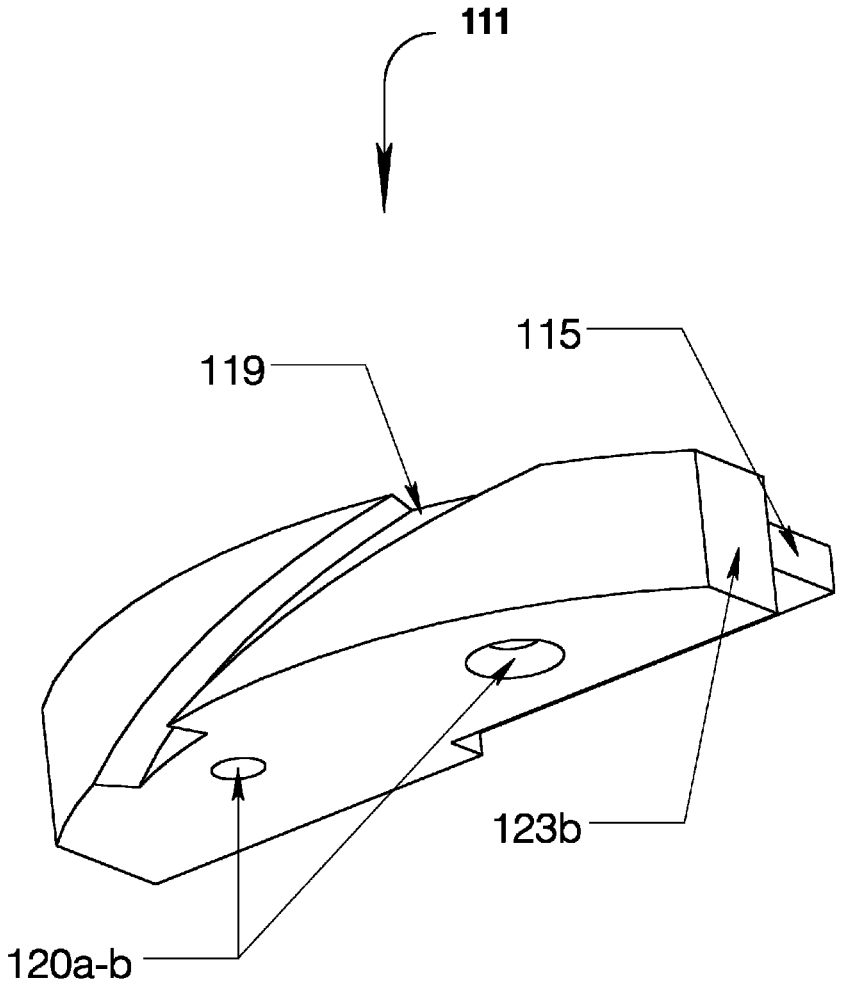
Figure 12:
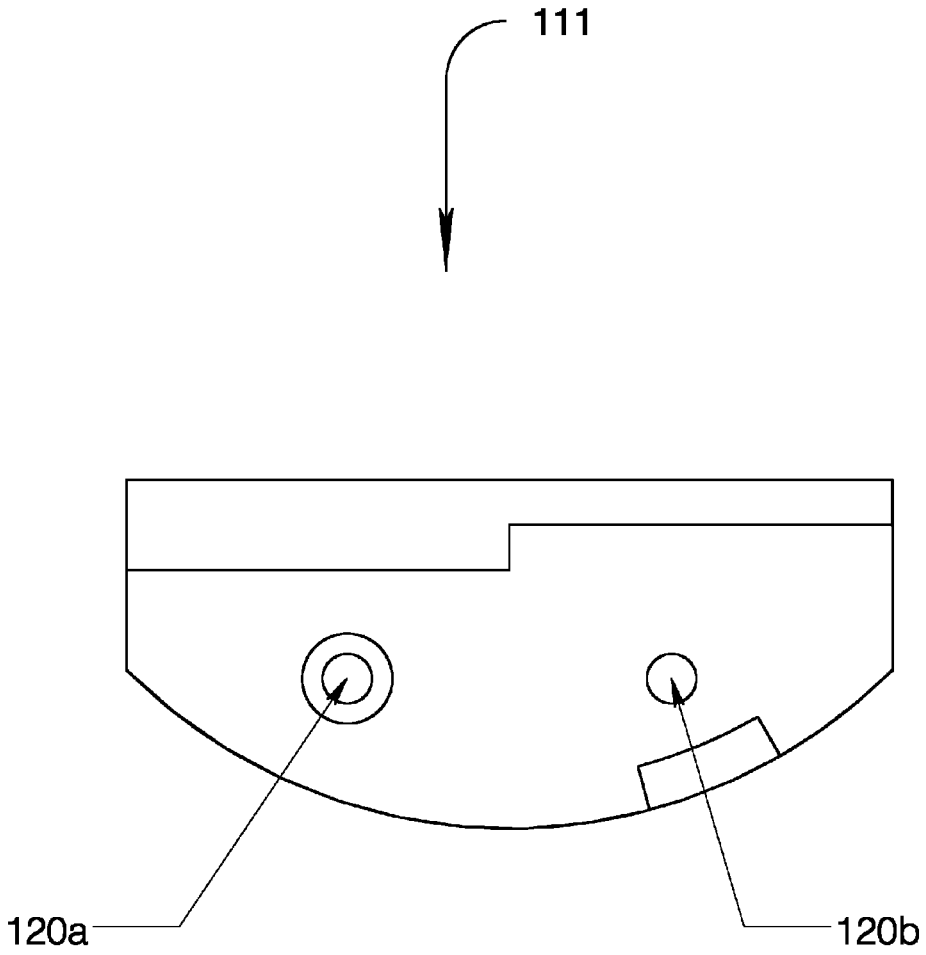
FIG. 12 is a side view of an arm base track of the present invention.
Figure 13:
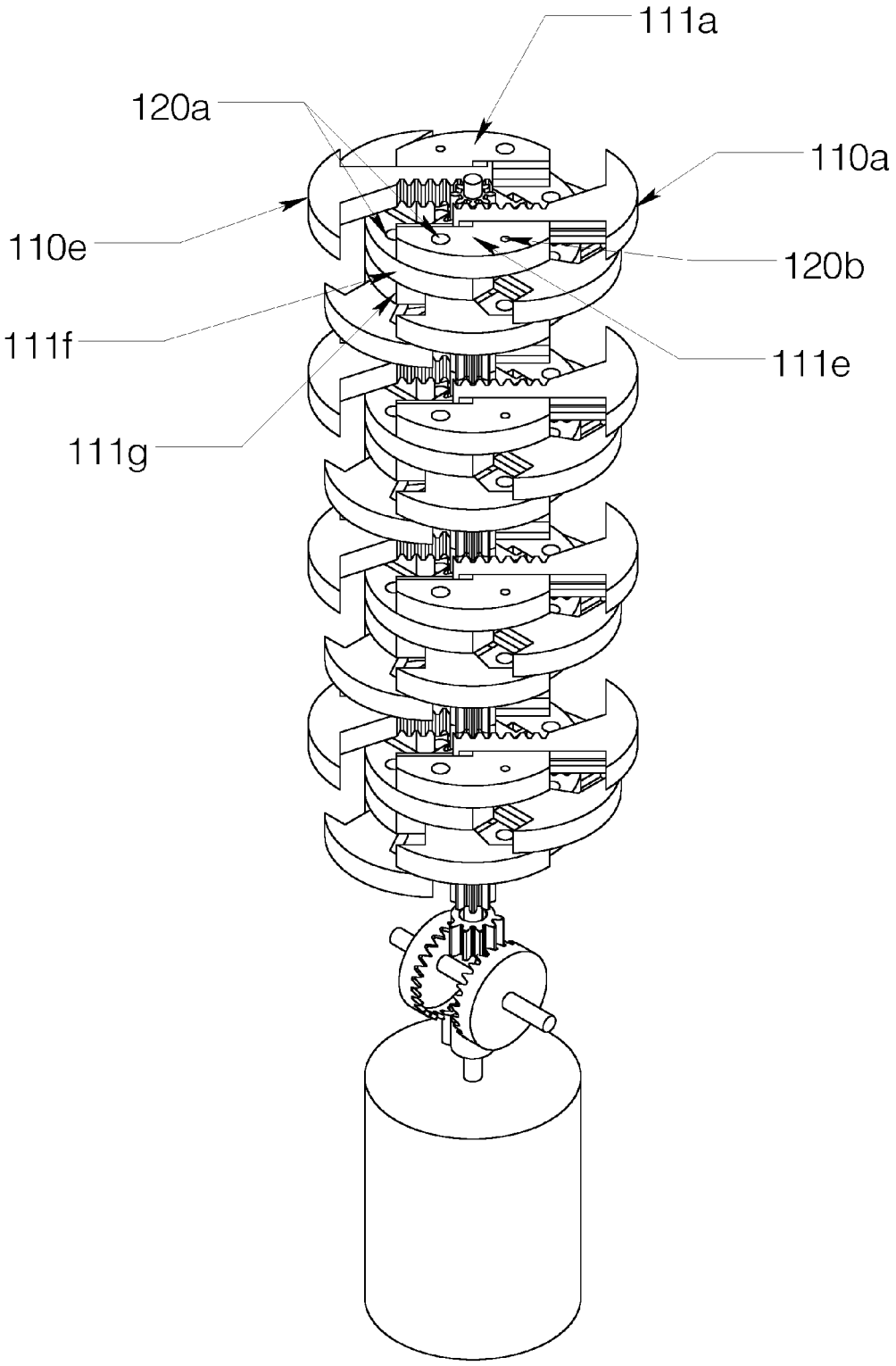
FIGS. 13-14 are a perspective and side view, respectively, of the central drive axis having dilator arms and arm base tracks mounted thereon in a helical manner, the dilator device being in a dilated position.
Figure 14:
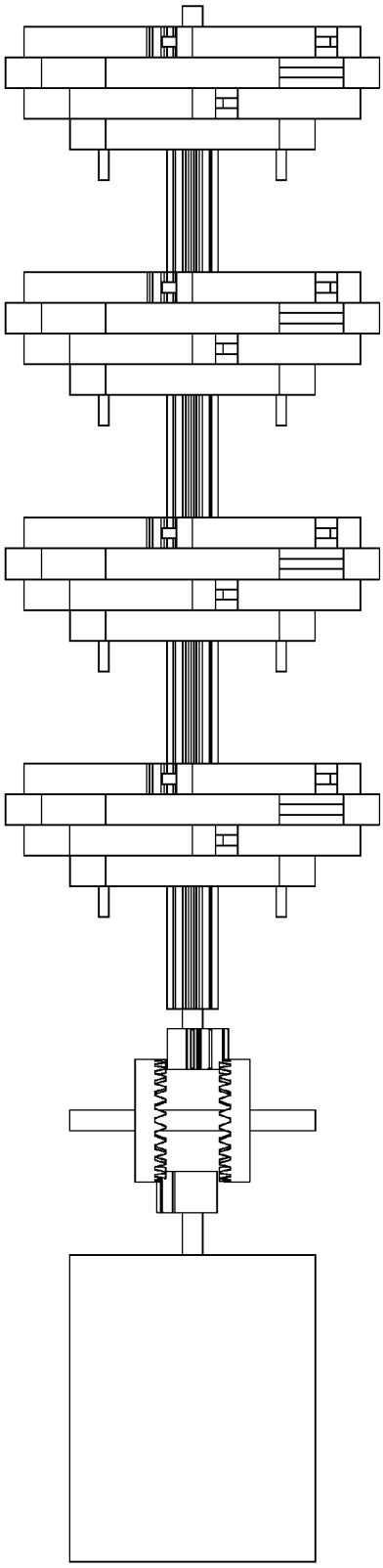
Figure 15:
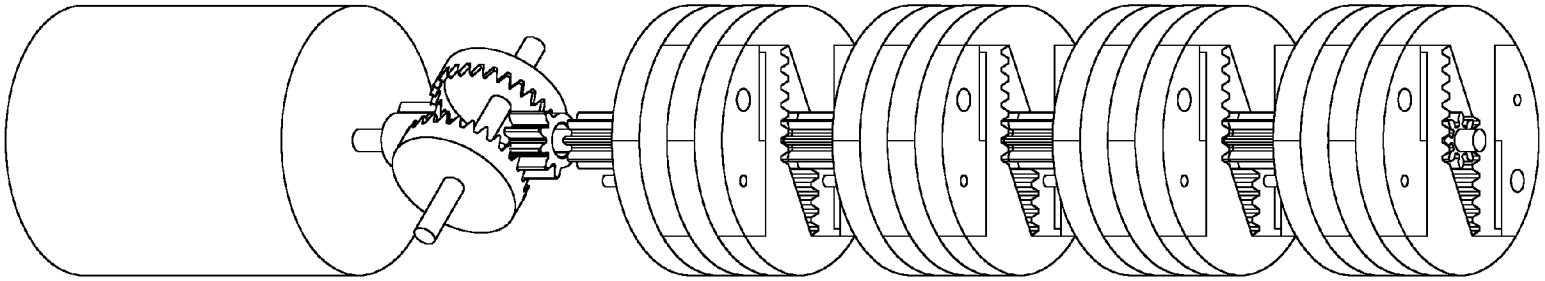
FIGS. 15-16 are a perspective and side view, respectively, of the central drive axis having dilator arms and arm base tracks mounted thereon in a helical manner, the dilator device being in a retracted position.
Figure 16:
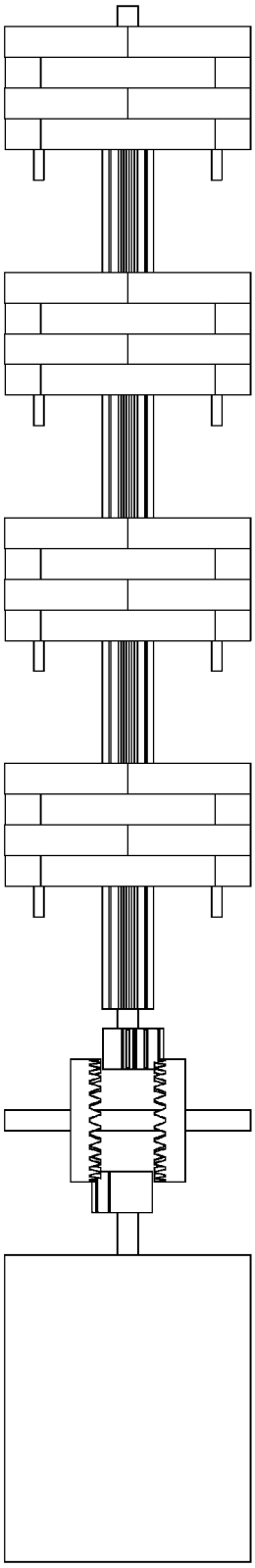
Figure 17:
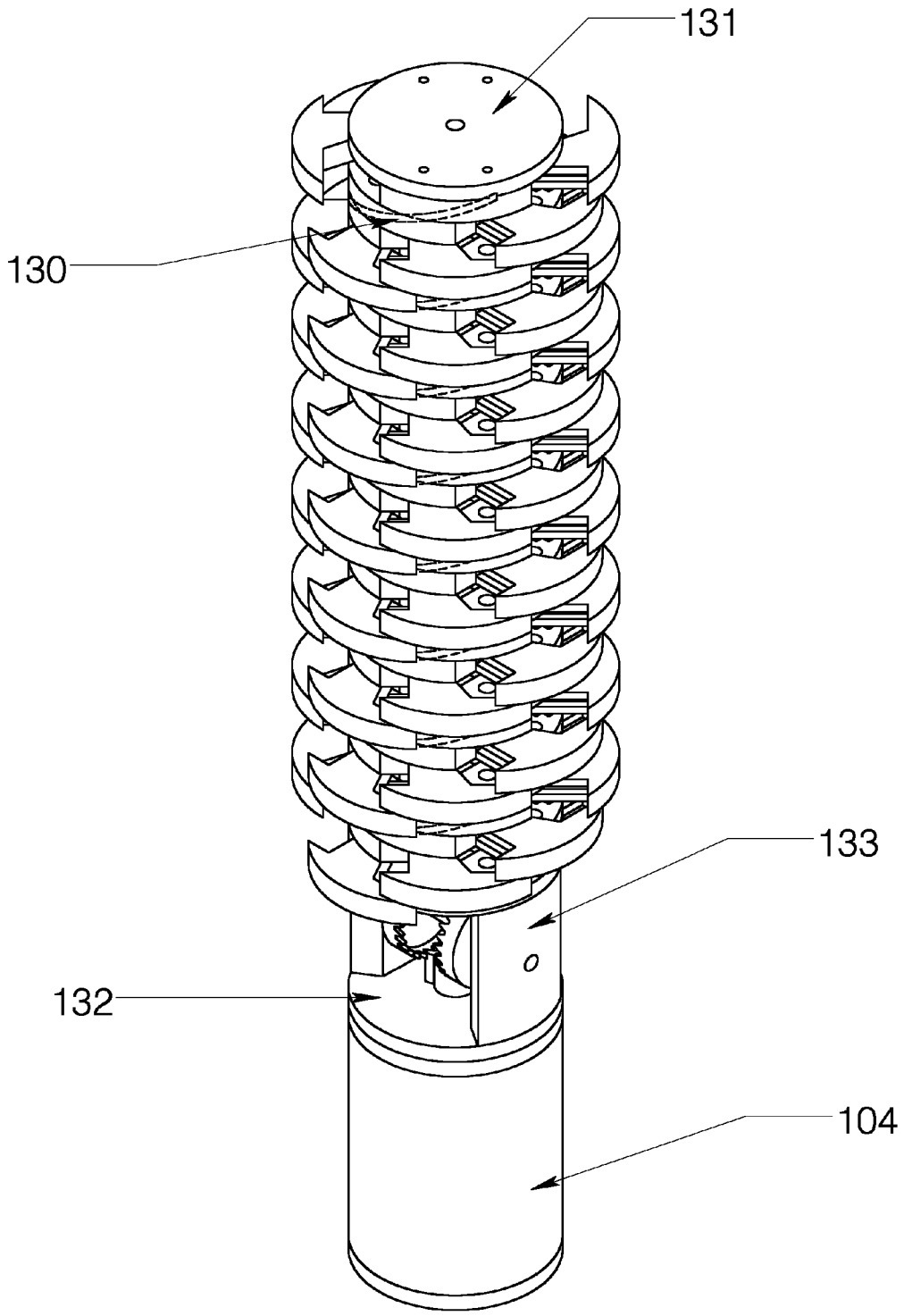
FIGS. 17-18 are a perspective and side view, respectively, of the complete internal assembly of the dilator device of the present invention which includes a helical channel for a heating element, the device being in the dilated state.
Figure 18:
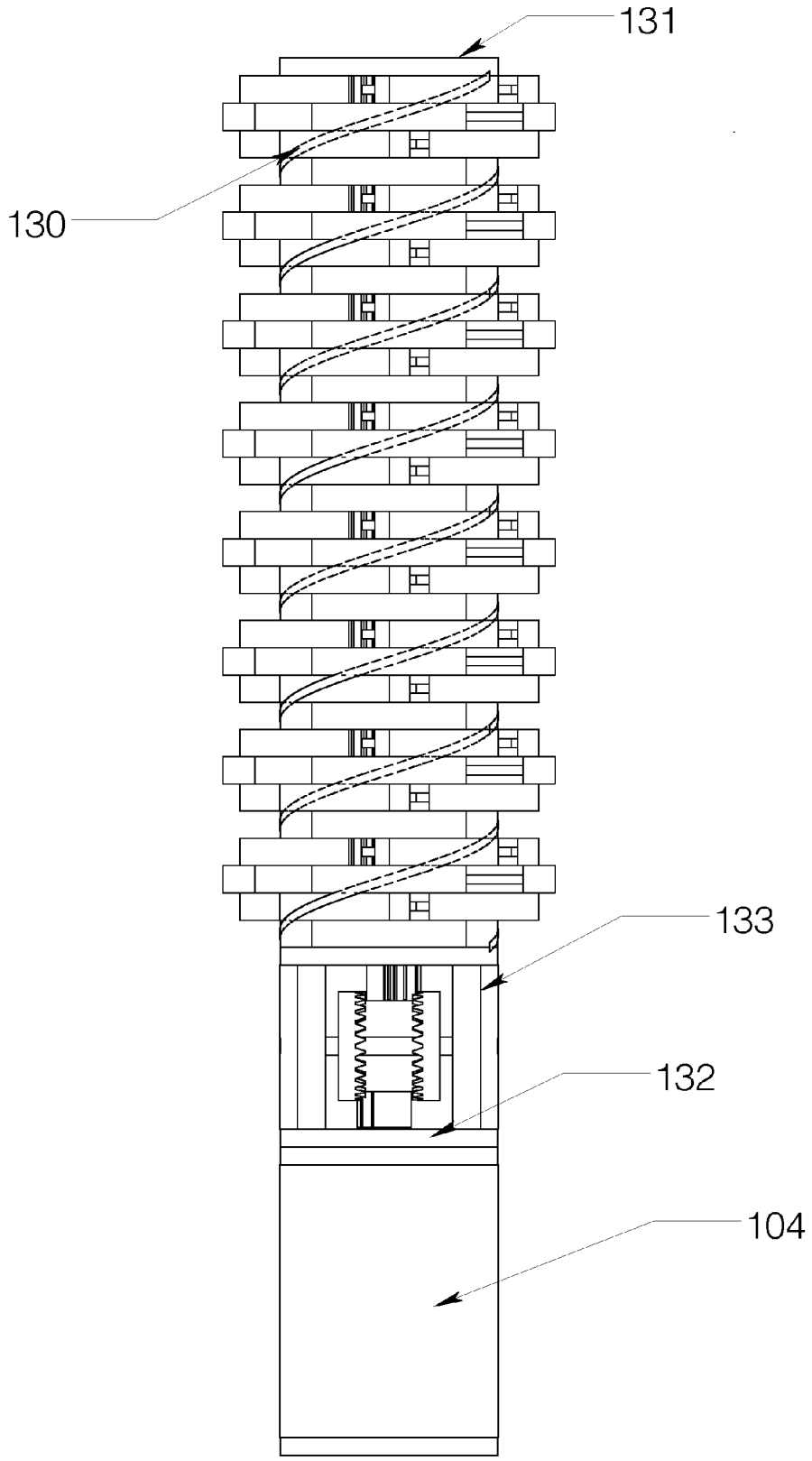
Figure 19:
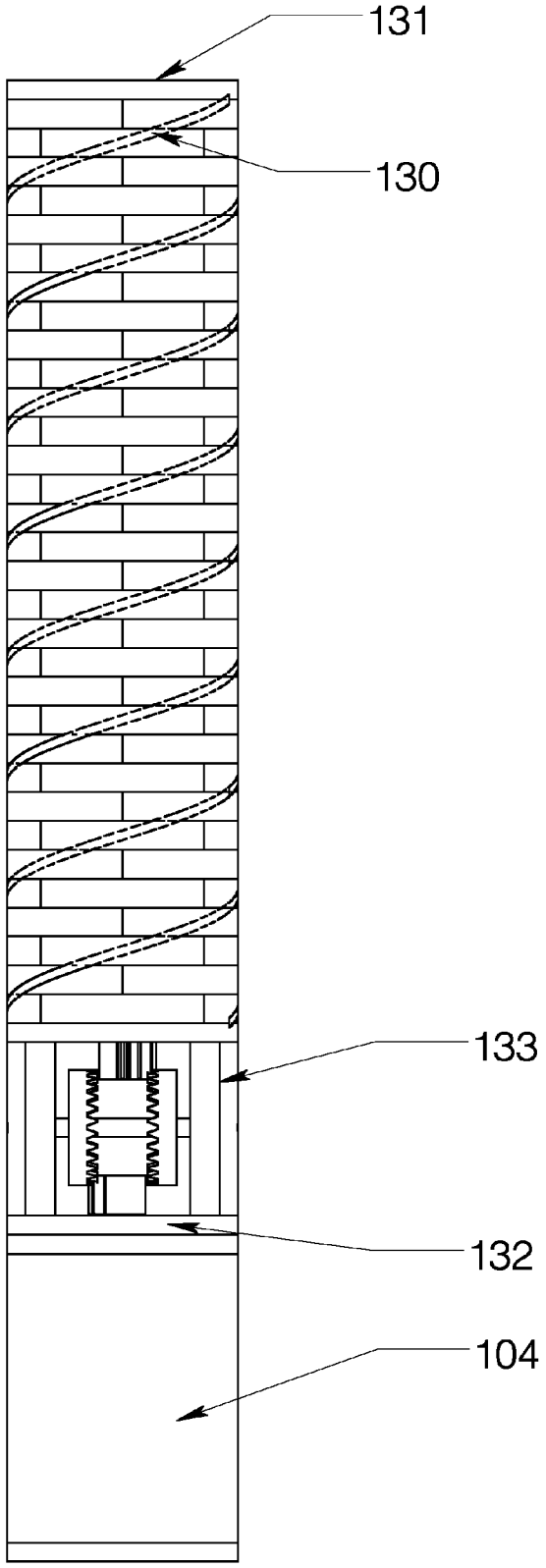
FIGS. 19-20 are a perspective and side view, respectively, of the complete internal assembly of the dilator device of the present invention which includes a helical channel for a heating element, the device being in the retracted state.
Figure 20:
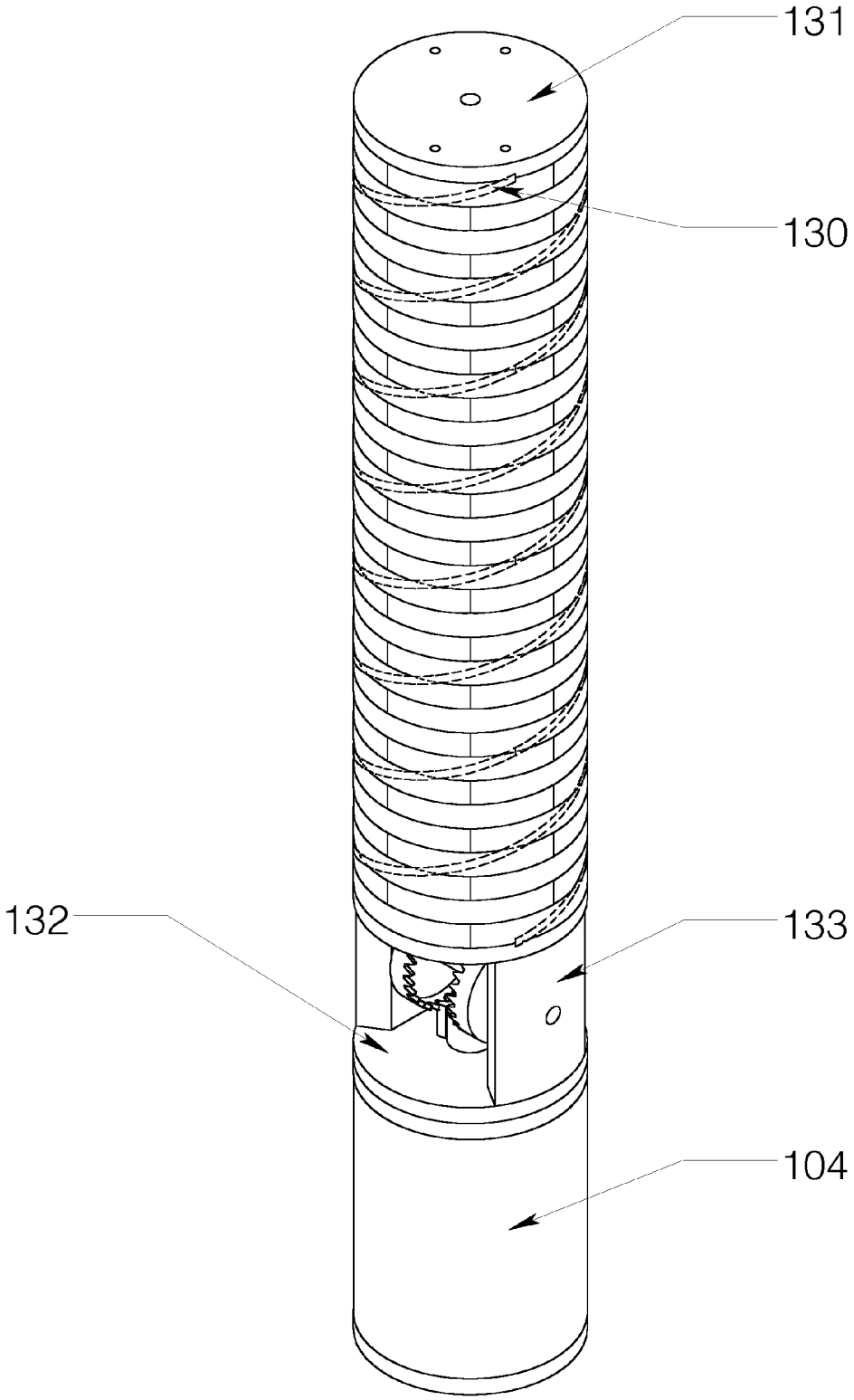
Figure 21:
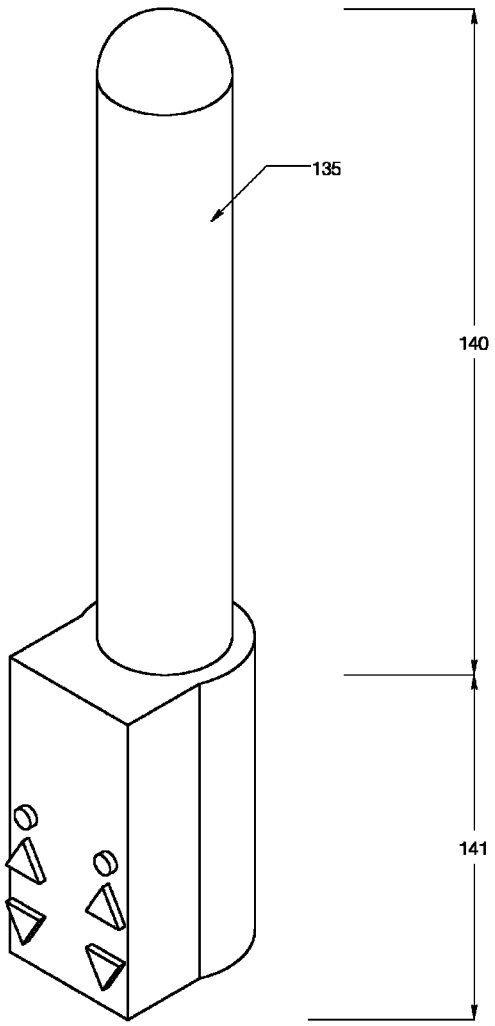
FIGS. 21-22 are a perspective and side view, respectively, of the dilator device having outer coverings, the device being in the retracted state.
Figure 22:
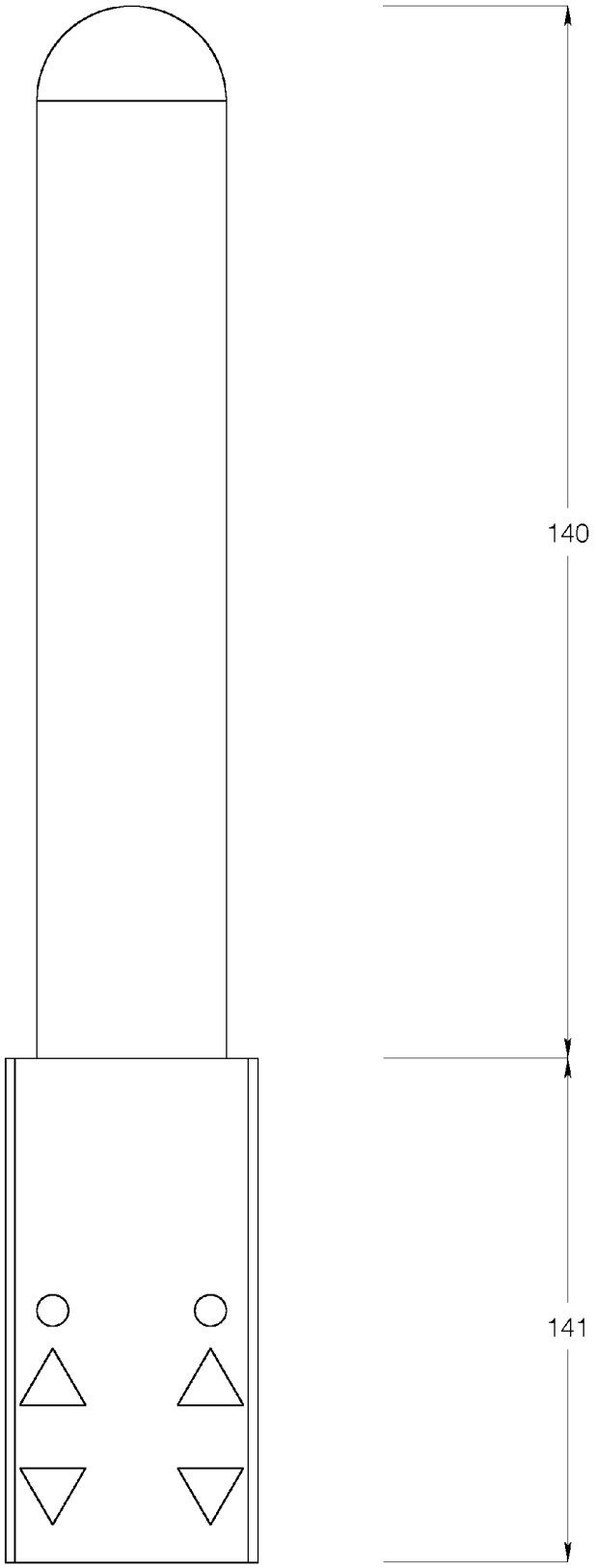

FIGS. 3-12 are discussed in detail in the next several paragraphs. FIGS. 3-6 show the internal assembly of dilator device 100 having dilator arms 110*a-h* in connection with arm base tracks 111*a-h*. FIGS. 3-4 show the dilator arms in a retracted position while FIGS. 5-6 show the dilator arms in a dilated or expanded position. FIGS. 7-9 provide perspective views and a top view of a single dilator arm 110, while FIGS. 10-12 provide perspective views and a top view of a single arm base track 111.

The design of dilator arms 110 and arm base tracks 111 are discussed first. Referring to FIGS. 7-9, the dilator arm comprises a distal end having a rounded outer section 112 which extends from or leads to an engaging section 113. The rounded outer section 112 is shown in the figures as having a flat base surface 121 and a rounded top which terminates at or joins with the flat base surface on both ends. A portion of the flat base surface along its width is connected to the distal end of the engaging section 113. The engaging section 113 has a shape which is substantially similar to the shape of the capital letter "Y" with the hollow area of the letter being made solid. The longer or leg portion of the Y is the proximal end of the engaging section and the top portion of the Y is the distal end of the engaging section. The distal end of the engaging section is preferably a solid piece which is in connection with the flat base surface of the rounded outer section 112 along its width. Preferably, the flat base surface 121 has a width which is greater than the width of the distal end of the engaging section such that a portion of the flat base surface 121 remains open on both sides of the distal end of the engaging section 113. These open surfaces are marked as 121*a* and 121*b* in FIGS. 7-9.

The proximal end of the engaging section 113 comprises a flat base 125 and contains a longitudinal slot, channel, groove or notch 114 which extends throughout the length of the engaging section 113 up to the distal end of the engaging section 113. The depth and shape of the slot, channel, groove or notch is selected so that it may slidably mate with or receive an outwardly extending protrusion or extending member 115 that runs the length of arm base track 111, as shown in FIGS. 10-12. Alternatively, one or more dilator arms 110 may have an engaging section with an outwardly extending member or notch along its length which slidably fits into a groove, slot or track contained on the arm base track 111. On the opposite side of the notch of engaging section 113 are one or more teeth 116 as shown in FIGS. 7-9. The teeth 116 are designed to mate with the notched exterior of the dilator arm drive pinion 105 such that when the dilator arm drive pinion is rotated, the one or more teeth 116 are engaged causing the dilator arm to move at a 90 degree angle to the length of the drive pinion 105. This movement of one or more dilator arms 110 from the retracted to dilated state will be explained further when referring to FIGS. 3-6 which will be discussed in greater detail below. It should further be noted that the teeth function to prevent slippage and ensure uniform motion of the dilator arms.

Referring to FIGS. 10-12, each arm base track 111 comprises a first side having a protrusion or extending member 115, a second side having a substantially curved surface 122, and two flat ends joining these two sides along the length of the arm base track, shown in the figures as first end 123*a* and second end 123*b*. The arm base track of FIGS. 10-12 is shown to have a channel 119 carved into its outer surface 122. The channel 119 is an optional element which may be included to accommodate one or more heating elements, such as a heating wire, into the dilator device 100. In one embodiment, when channel 119 is included in one or more arm base tracks 111, the channel is carved into each arm base track 111 such that the aggregate forms a helix around the length of the device, as is shown in FIGS. 17-20 which will be discussed in greater detail below. Arm base track 111 includes one or more apertures 120*a-b*, which may be designed to fit one or more screws, such as a countersunk mounting screw.

When the device is assembled, a countersunk mounting screw is preferably inserted into the aperture 120*a* of a first arm base track 111 such that the top of the screw sits substantially flush with the top surface of the first arm base track 111. The screw preferably has a length such that it is fastened to the aperture 120*b* of second arm base track 111 sitting immediate underneath it, such that the bottom of the screw is flush with the underside surface of the second arm base track 111. The orientation achieved by the continuous stacking and fastening of arm base tracks 111 through apertures 120*a-b* results in arm base tracks which are mounted in a slightly offset manner such that aperture 120*a* of a first arm base track is threaded into aperture 120*b* of a second arm base track lying beneath the first arm base track.

Referring again to FIGS. 3-6, when the motor 103 is turned on, the second alternating spur gear 117*b* begins to rotate, which rotates the crown gears 107*a* and *b*. The crown gears in turn rotate the first alternating spur gear 117*a* which rotates dilator arm drive pinion 105. As the dilator arm drive pinion rotates in a counter-clockwise direction, for example, the teeth 116 of dilator arms 110*a-h* are engaged by the motion of dilator arm drive pinion 105 such that the dilator arms are expanded radially away from the center point of dilator arm drive pinion 105. This outward movement of dilator arms 110*a-h* is illustrated in FIGS. 5 and 6, which shows the dilator device 100 being transitioned from a retracted state to a dilated state. When the dilator arm pinion rotates in a clockwise direction, the teeth 116 of dilator arms 110*a-h* are engaged by the motion of the dilator arm drive pinion such that the dilator arms are retracted inwards towards the center point of the dilator arm drive pinion. FIGS. 3-4 illustrate the dilator device 100 in a fully retracted position such that the dilator arm drive pinion 105 has been rotated fully in the clockwise direction.

When the device is in the fully retracted position, as shown in FIGS. 3-4, a pair of dilator arms 110 and a pair of arm base tracks 111 are designed to fit together around the dilator arm drive pinion 105, forming the shape of a circle. As shown in FIG. 3, dilator arms 110*a* and 110*e* fit together with arm base track 111*a* and 111*e* such that the surface 121*a* of dilator arm 110*a* is in contact with the second end 123*b* of an arm base track 111*a* and base 125 of dilator arm 110*e*. The groove 115 of arm base track 111*a* is slidably mated into notch 114 of dilator arm 110*e*. Surface 121*b* of dilator arm 110*a* is in contact with the first end 123*a* of arm base track 111*e* and the extended member or protrusion 115 of arm base track 111*e* is slidably mated into the notch 114 of the dilator arm 110*a*.

Similarly, surface 121*a* of dilator arm 110*e* is in contact with the second end 123*b* of arm base track 111*e* and base 125 of dilator arm 110*a*. Surface 121*b* of dilator arm 110*e* is in contact with the first end 123*a* of arm base track 111*a*. Each additional pair of dilator arms and arm base tracks fit together in this way, as is shown in FIG. 3.

The extent of dilation of the insertion section 140 of the device may range from 0.5 cm to 10 cm, preferably between 1 cm to 5 cm. There are an infinite number of steps of dilation which can be achieved as the device expands and/or contracts and these steps can be set either by the user or in predetermined increments. For example, the device may expand in increments of approximately 0.05 cm to 1.0 cm.

The length of the insertion section 140 of the device should be sufficient to massage and/or stretch the interior muscles of the vagina or anus/rectum. The length of the insertion section of the device is typically longer than the average anatomical length of the vagina or anus/rectum in order to allow for easy handling by the user. The length of the insertion section may thus be from 3 cm to 20 cm, and may be adjustable either telescopically or otherwise in order to accommodate the user in inserting the device into the intended bodily cavity.

In this way, a patient may select a minimum and/or maximum diameter of the dilator device using a control section such that the device may continually expand and contract to these predetermined lengths. The patient may also set the amount of time the device should remain at each predetermined diameter length. The control section of the device may accommodate various features, including the ability to create "sets" of exercise routines which begin at a particular diameter and gradually expand to a larger or smaller diameter after a predetermined amount of repetitions of expansion and contraction. These settings may be pre-set by the patient or doctor, the device may have default exercise routines for the patient to practice with the capability of the patient to override any settings which are not desired in real time. The control section of the device may also be used without a predetermined exercise routine, where the patient has complete control in real time over the operation of the device. The device may also have a vibrating and/or rotating feature which may be controlled by the patient in this same manner.

The device preferably includes a maximum expansion size to protect the patient from any malfunctioning of the electrical control of the device, such that the motor switches off or automatically retracts in diameter when it approaches a maximum diameter. This maximum expansion size may be set by the patient and/or may additionally be set by the product manufacturer. As previously explained, the alternating spur gear and crown gear assemblies are the mechanical limiters of the expansion of the device. One of the main functions of the alternating spur gear arrangement is to allow for the motor to continue in one continuous direction, but when a predetermined limit of travel of the spur gears is reached, the motion of the spur gears is reversed so that the device does not expand beyond the predetermined limit.

The control section of the device may include a memory which records sets completed, the maximum and minimum dilation states or diameters achieved by the patient, and may be reviewed by the patient to track progress. The patient may also wish to share her progress with her doctor for further treatment advice.

FIGS. 13-16 show the dilator device 100 having 16 pairs of dilator arms and arm base tracks which form 16 levels along the length of the dilator arm drive pinion 105. Arm base track 111*e* includes apertures 120*a-b* which may be designed to fit one or more screws, such as a countersunk mounting screw. When the device is assembled, a countersunk mounting screw is inserted into the aperture 120*a* of arm base track 111*e* such that the top of the screw sits substantially flush with the top surface of the arm base track 111*e*. The screw preferably has a length such that when it is threaded into the aperture 120*b* of arm base track 111*f* sitting immediately underneath it, the bottom of the screw is flush with the underside surface of the arm base track 111*f*. In this way, arm base track 111*e* is offset from arm base track 111*f* because aperture 120*a* of arm base track 111*e* is aligned with aperture 120*b* of arm base track 111*f*. Arm base track 111*g* is offset from arm base track 111*f* because aperture 120*a* of arm base track 111*f* is aligned with aperture 120*b* of arm base track 111*g*. The orientation achieved by the continuous stacking and fastening of arm base tracks 111 through apertures 120*a-b* results in arm base tracks which are mounted in a helical manner along the length of the dilator device 100.

When arm base tracks 111 are mounted in this way, the dilator arms 110 which extend radially outwards and retract inwards are also mounted in a helical manner along the length of the dilator device. The arm base tracks and dilator arms are mounted in this manner in order to achieve an even expansion and contraction along the length of the dilator device 100. Radial expansion and contraction is also evenly distributed such that a constant diameter may be maintained according to the patient's settings.

FIGS. 17-20 illustrate the entire internal assembly of the dilator device 100, having several pairs of dilator arms and arm base tracks. A heating wire 130 is shown to be inserted into channel 119 in these figures. Incorporating a heating element into the dilator device allows the device to be heated to the patient's preference such that the temperature of internal tissues of the bodily orifice is maintained, thus promoting the relaxed state of the patient of the device and encouraging the gradual expansion of the orifice being treated. The temperature of the heating wire 130 may be controlled by the patient or may be kept at a predetermined optimal temperature. The temperature may be set such that the insertion section of the device is from 95° to 110° F. and is preferably set to 104° F.

Head end anchor plate 131 of the dilator device is fastened to the top of dilator arm drive pinion 105 by any conventional means, such as using a threaded screw. In one embodiment, additional apertures are present on the arm base tracks forming the top of the stack to accommodate one or more fasteners which mount the head end anchor plate 131 to the arm base tracks. Differential housing base plate 132 is also included in the dilator device by any conventional means, such as using one or more threaded screws. The motor 103 may be present within motor housing 104 and a differential covering 133 may be used to protect the alternating differential assembly 102.

Figure 23:
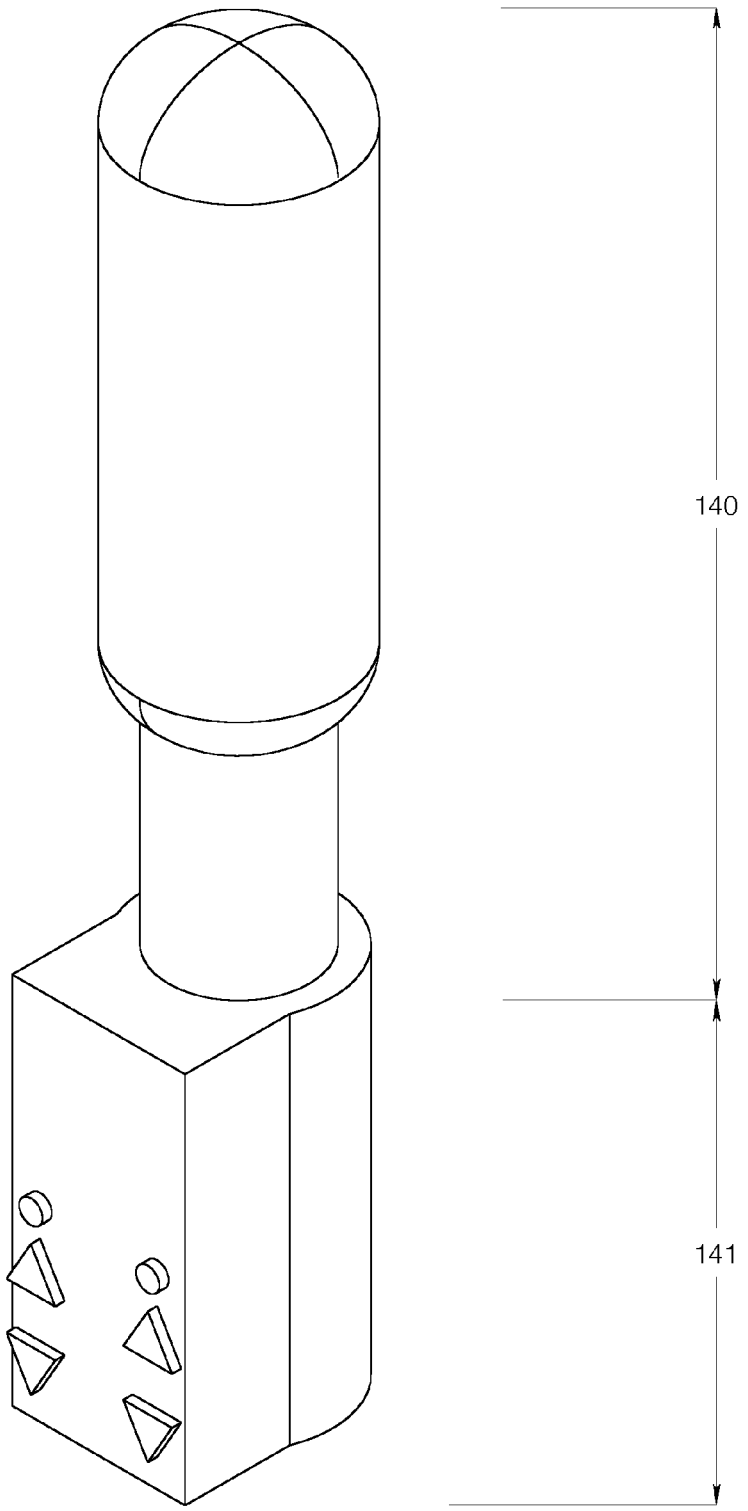
FIGS. 23-24 are a perspective and side view, respectively, of the dilator device having outer coverings, the device being in the dilated state.
Figure 24:
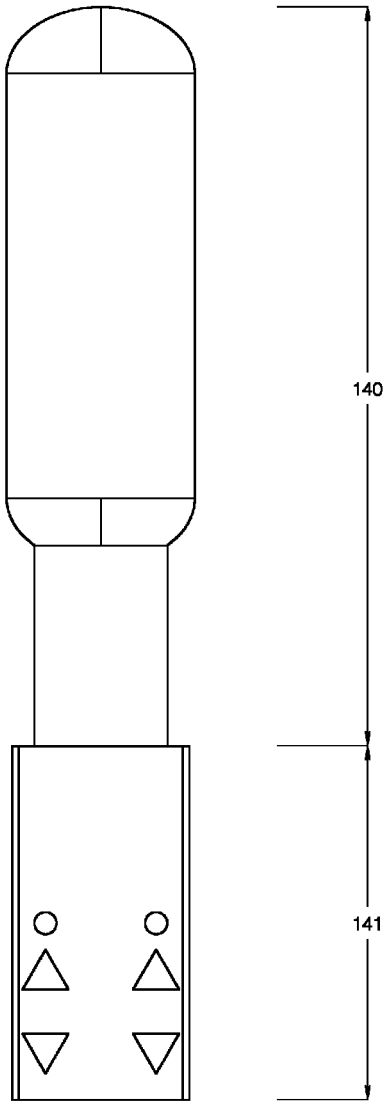
Figure 25:
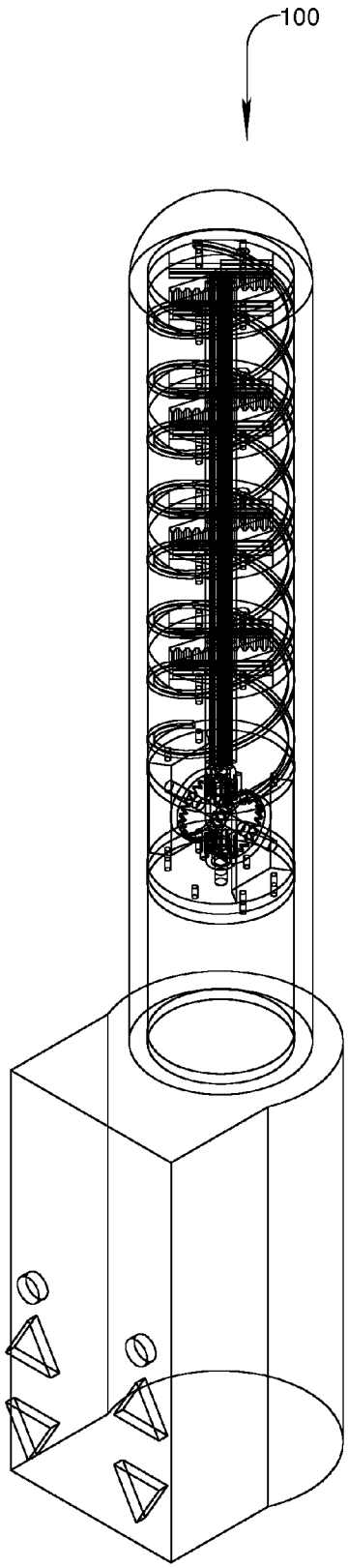
FIGS. 25-26 are a perspective and side view, respectively, of the dilator device of the present invention showing the internal assembly as well as the outer covering of the device.
Figure 26:
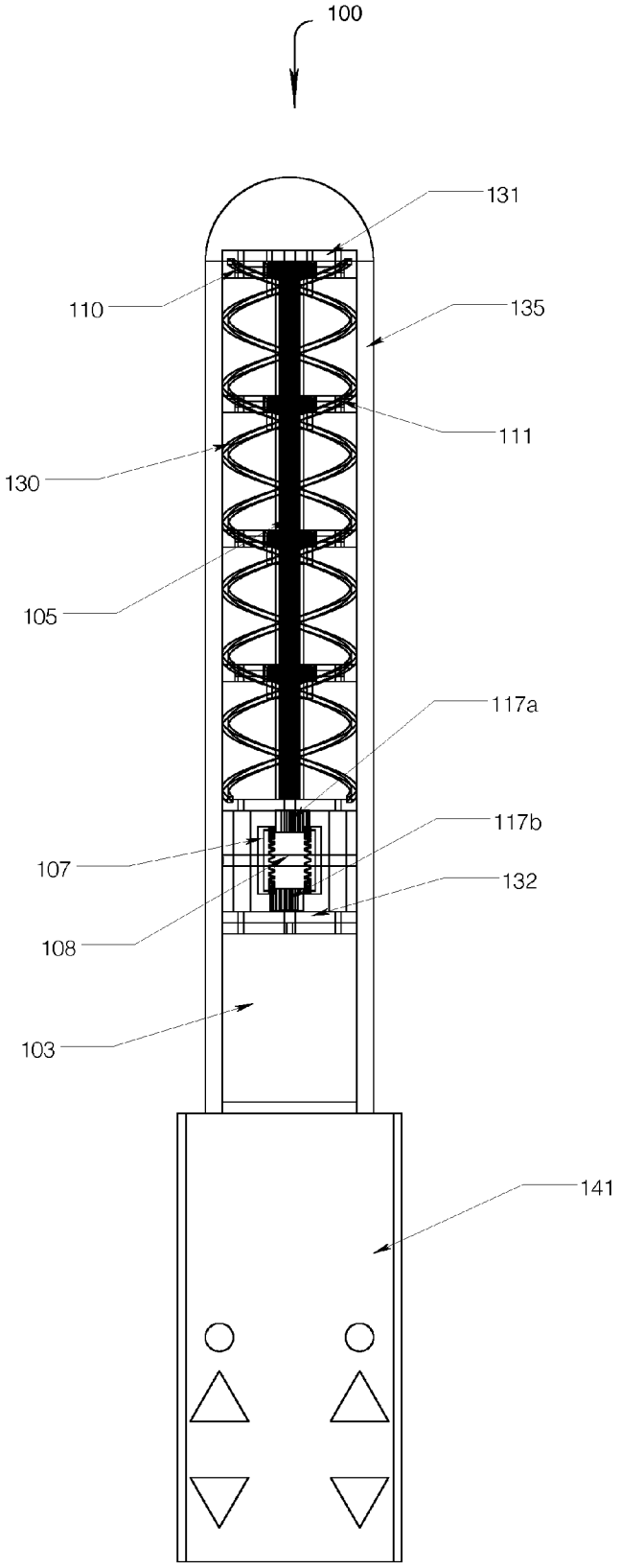

FIGS. 21-24 illustrate the exterior of the dilator device in a retracted state (FIGS. 21-22) and a dilated state (FIGS. 23-24). The exterior of the dilator device comprises the insertion section 140 of the device and the control section 141 of the device. The insertion section 140 is the portion of the dilator device which may be inserted into the orifice to be treated while the control section 141 of the device may be held by the patient to manipulate various features of the device. The control section 141 may be attached to the insertion section 140 to form a single unit, as shown in the figures. Alternatively, the control section 141 may be detached from the insertion section of the device, such that the patient may conveniently control various settings of the dilator device without having to change positions to reach for the device. For example, the control section may be a hand-held piece which is connected to the insertion section by a bundle of wires which are preferably covered in a plastic covering. The control section may also be a remote control which is fully detached from the insertion section 140 of the device.

A covering 135 covers the insertion section of the device, and a covering 136 houses the control section 141, which contains the power source and logic for controlling the various features of the device, as discussed above. The covering 135 may be made from any FDA approved material for tissue contact use. In one embodiment, the covering 135 is made of a silicon rubber material. It should be understood that a variety of materials may be used for the covering and the invention is not limited by the choice of these materials.

The device may be powered through an electrical outlet or may include a section for housing one or more batteries. The covering 136 may have one or more keys or buttons for the patient to manipulate for controlling the various parameters of the dilator device, such as temperature of the heating element, diameter of the insertion section 140, frequency and/or number of sets of iterations of expansion and contraction of the dilating arms, length of the dilator, and other features which may be accommodated by the device such as a vibrating mode or a rotating mode.

In one embodiment, the diameter of the insertion section of the dilator device may be set such that it is not constant along the length of the device. For example, the bottom of the insertion section could be set by the patient to have a smaller diameter than the top of the insertion section such that different sections of the internal orifice may be exercised independently from each other.

In another embodiment, the device can be shortened and lengthened, thus allowing the patient to vary the insertion length of the dilator.

The device can be used primarily for two purposes, therapeutic and sexual pleasure. For the therapeutic use, the device is inserted into the body orifice, i.e., vagina or rectum, and operated to slowly expand the diameter of the orifice. It is expected that because of the respective diameters of the orifice and device, the device will be readily retained within the orifice. Therefore, there will be minimal need for a mounting system or halter to retain the device within the orifice. Nonetheless, to provide more assurance to the patient that the device will not all out during use during regular activities, the device can be fitted with a strap or halter to prevent the device from completely falling out of the orifice. The strap can be similar to underwear by being worn around the user's waist. In some situations, merely wearing underwear over the device will give sufficient assurance that the device will not drop out of the orifice and onto the ground during use.

In therapeutic use, the patient will use the device over a period of weeks to months. The patient may use the device during the day, the night, or both. The patient will gradually increase the outer diameter of the expansion of the device until desired diameter of the orifice is achieved.

In use for achieving sexual pleasure, the device can be programmed to rapidly increase and decrease the diameter providing a vibratory sensation to the user. The degree in change in diameter can be varied to enhance or diminish the sensations.

FIGS. 27-43 show the dilator device 200 according to a second embodiment of the invention. The internal mechanism for the dilator device 200, shown in FIG. 27, comprises a central drive axis comprising a cam drive pinion shaft 205, an AC or DC motor housing 204 and a control section 241. The cam drive pinion shaft 205 may be rotated in the same manner as the dilator arm drive pinion 105 in the first embodiment of the invention and as explained in connection with FIGS. 1 and 2. That is, the dilator device 200 may have all or some of the components which function to enable the drive pinion to rotate. These components are explained in detail in connection with FIGS. 1 and 2.

Figure 27:
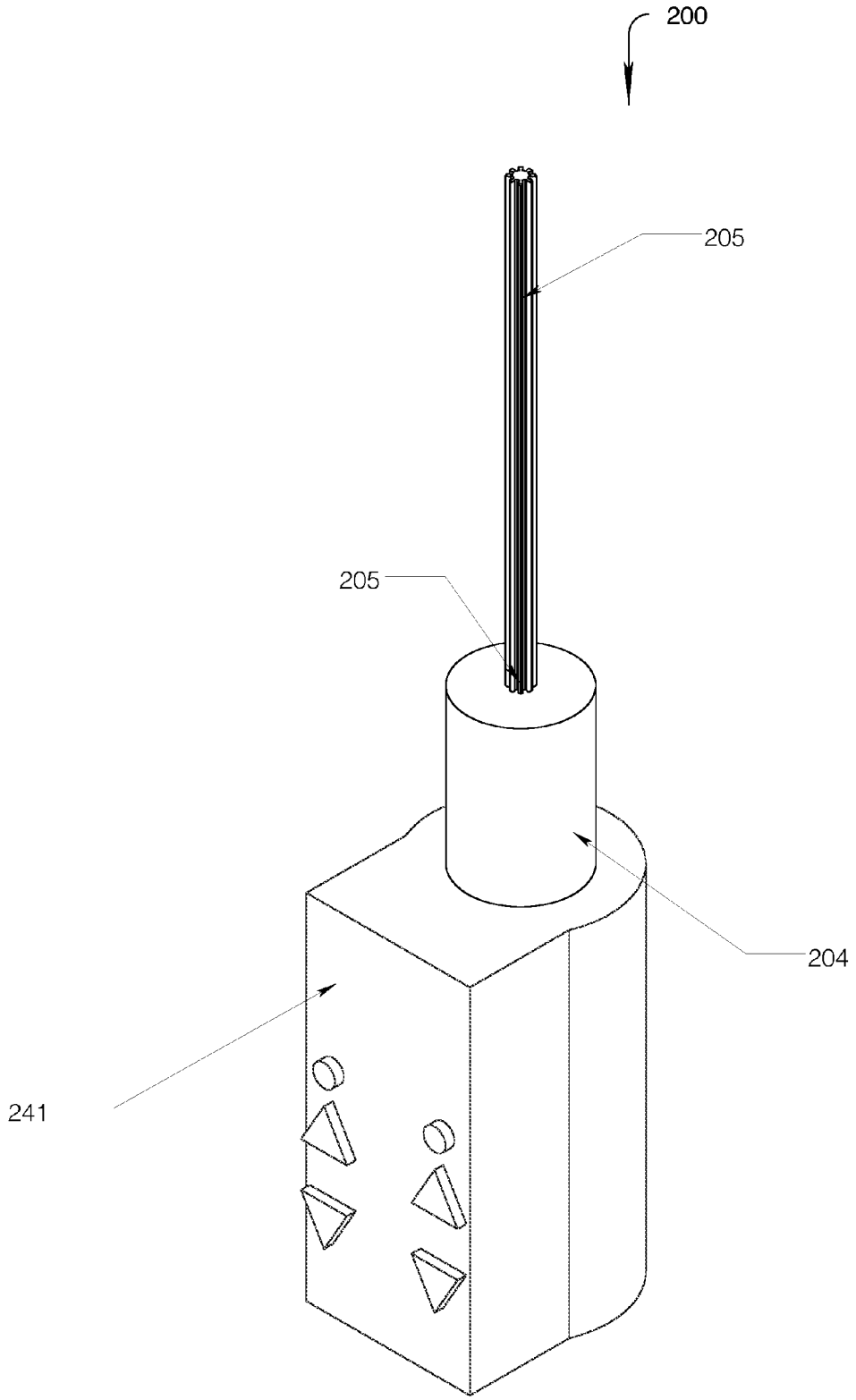
FIG. 27 is a perspective view of a second embodiment of the invention, showing the central drive axis of the dilator device.
Figure 28:
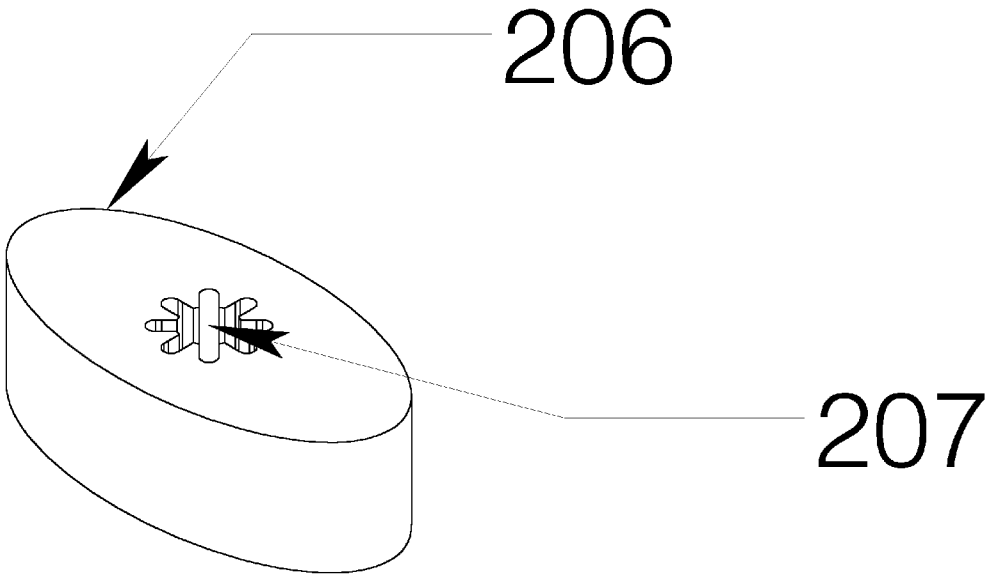
FIG. 28 shows an inner cam according to a second embodiment of the invention.
Figure 29:
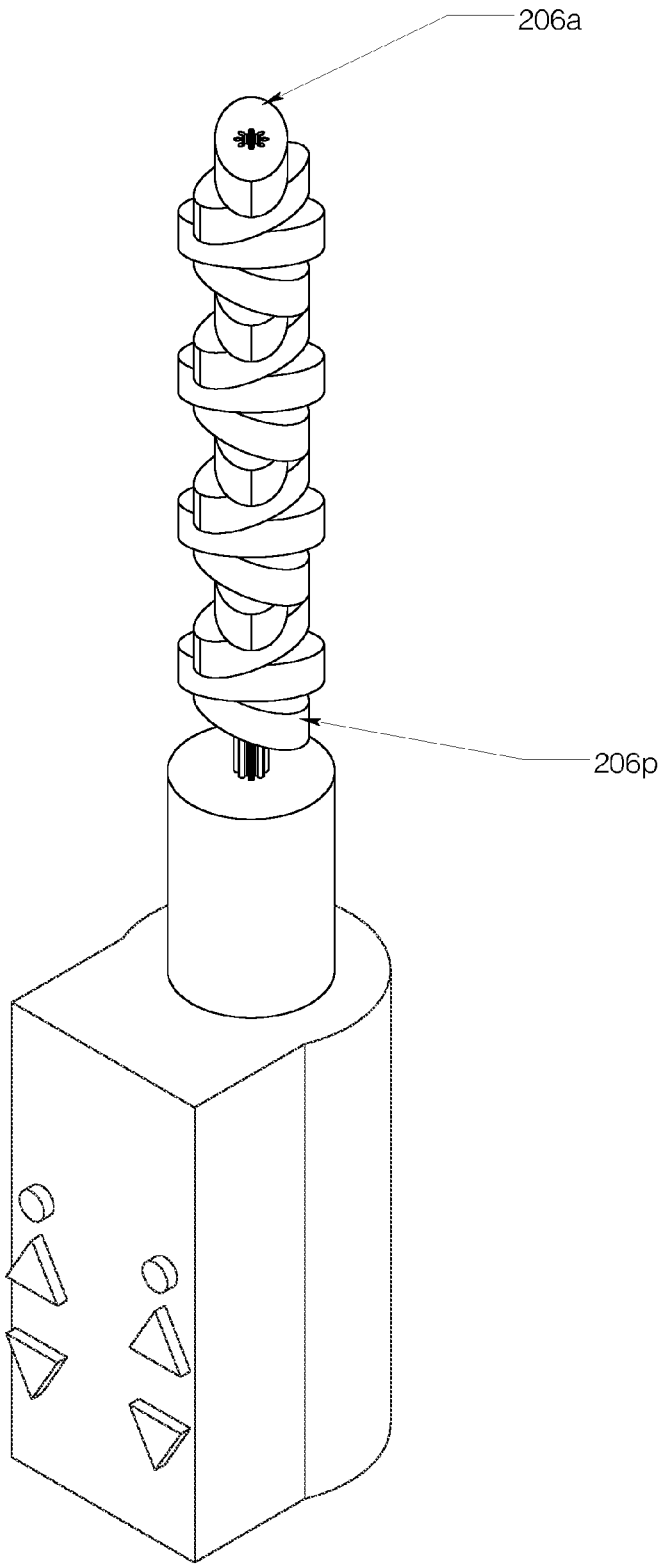
FIGS. 29-31 show a number of inner cams positioned on the cam drive pinion shaft according to a second embodiment of the invention.
Figure 30:
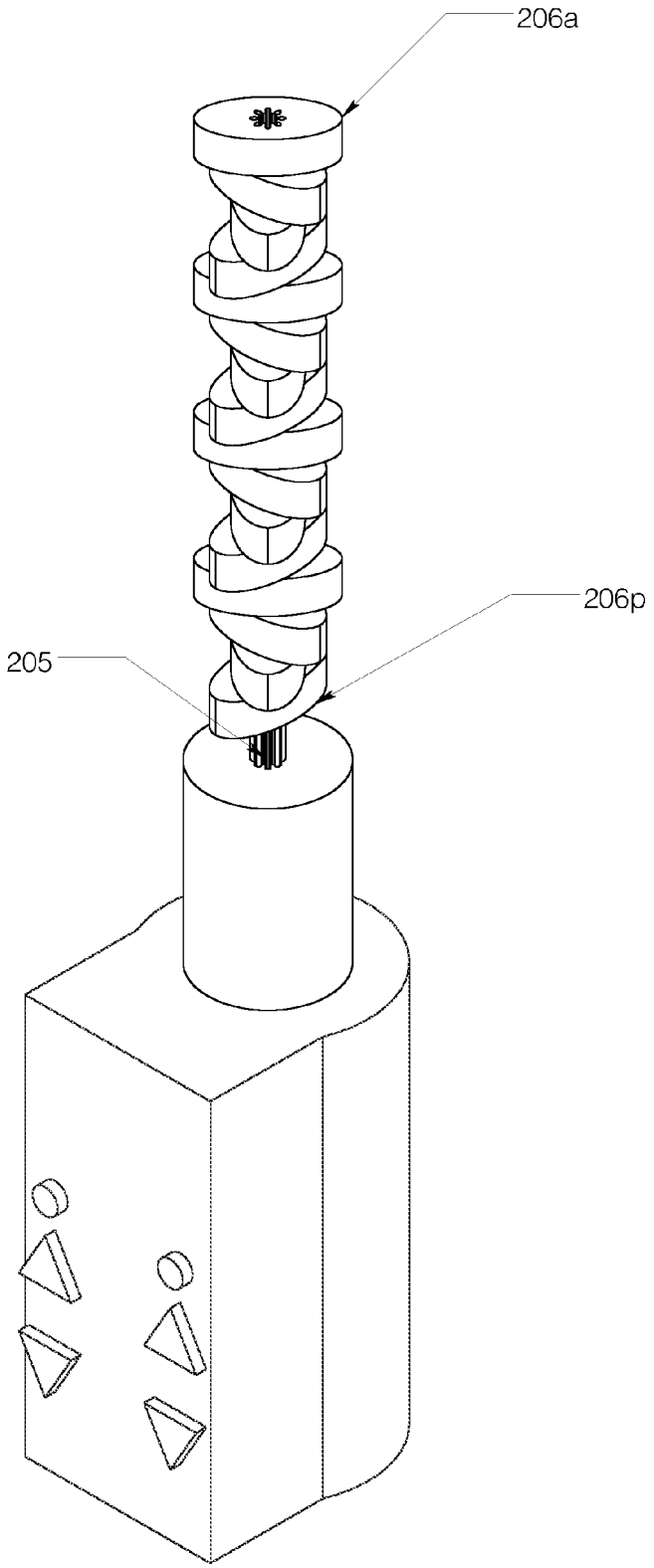
Figure 31:
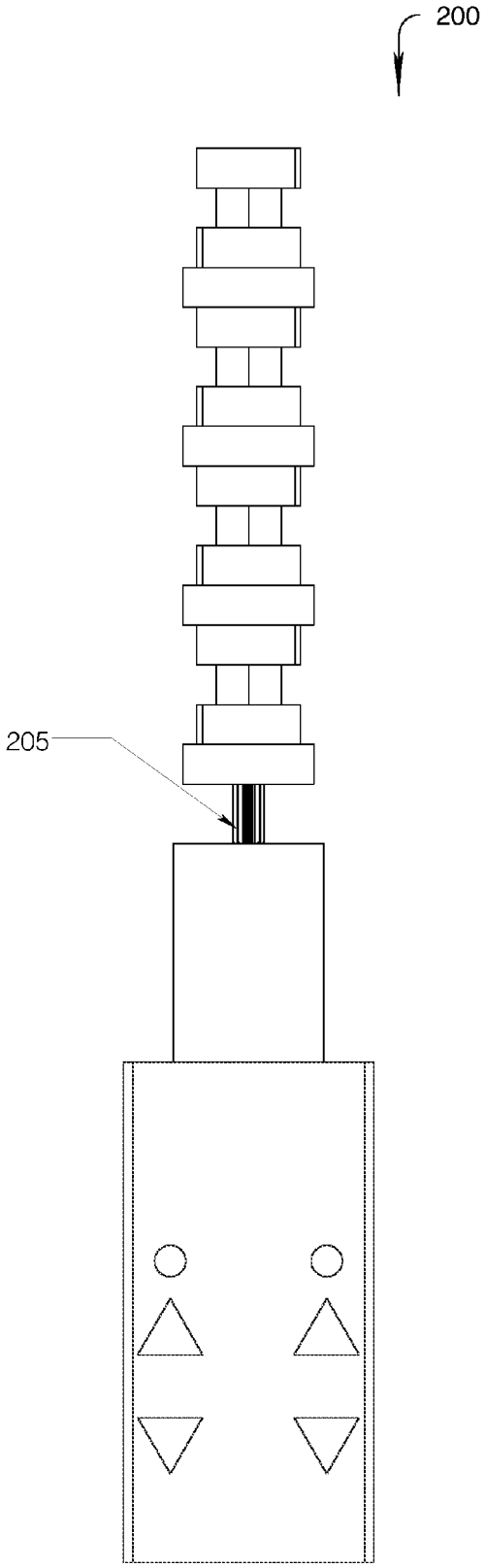

FIG. 28-31 show the inner cam component 206 having a center bore 207 which may be designed to mate with the outer perimeter of the cam drive pinion shaft 205 such that as the cam drive pinion shaft rotates, the inner cam 206 also rotates in the same direction. For example, FIGS. 27 and 28 show the pinion shaft being a splined shaft and thus the center bore 207 may mate with the pinion shaft by having the mating or negative shape. The outer surface of the inner cam 206 may be configured in a variety of shapes. For example, the outer surface of the inner cam 206 may have an elliptical or oval shape as is shown in FIG. 28. FIG. 29 shows a number of inner cams 206*a-p* placed in a stacked manner with each cam oriented approximately 45 degrees relative to the adjacent cams FIGS. 29 and 31 show the cams oriented such that the dilator device 200 is in a contracted state, whereas FIG. 30 shows the cams oriented such that the dilator device 200 is in a dilated state. Although the relative orientation of one cam in comparison to the adjacent cams does not change between the contracted and dilated state, their absolution position relative to, for example, the control section 241 does change. The difference between the dilated and contracted states will be more apparent as the additional outer components of the dilator 200 are explained below.

Figure 32:
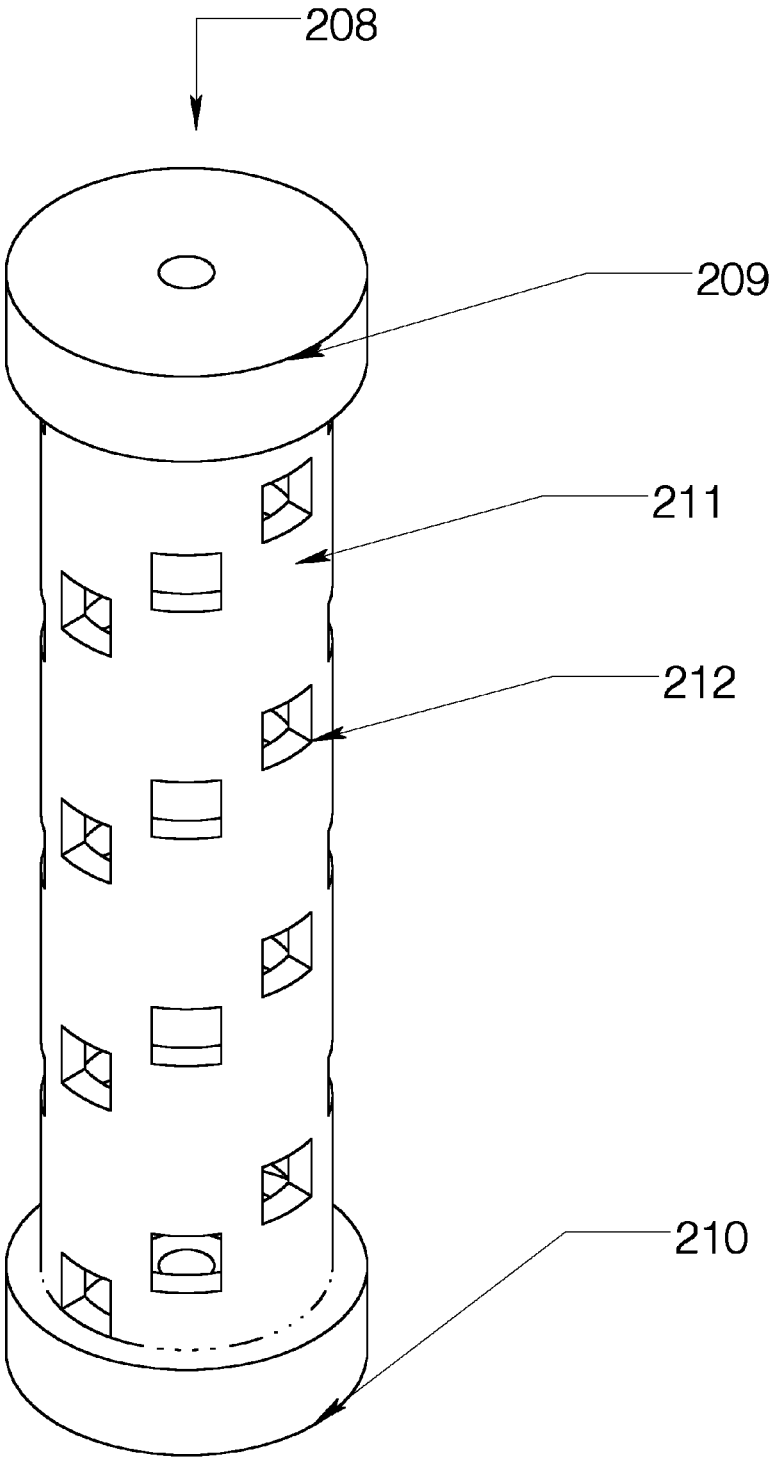
FIGS. 32-33 show the cam housing according to a second embodiment of the invention.
Figure 33:
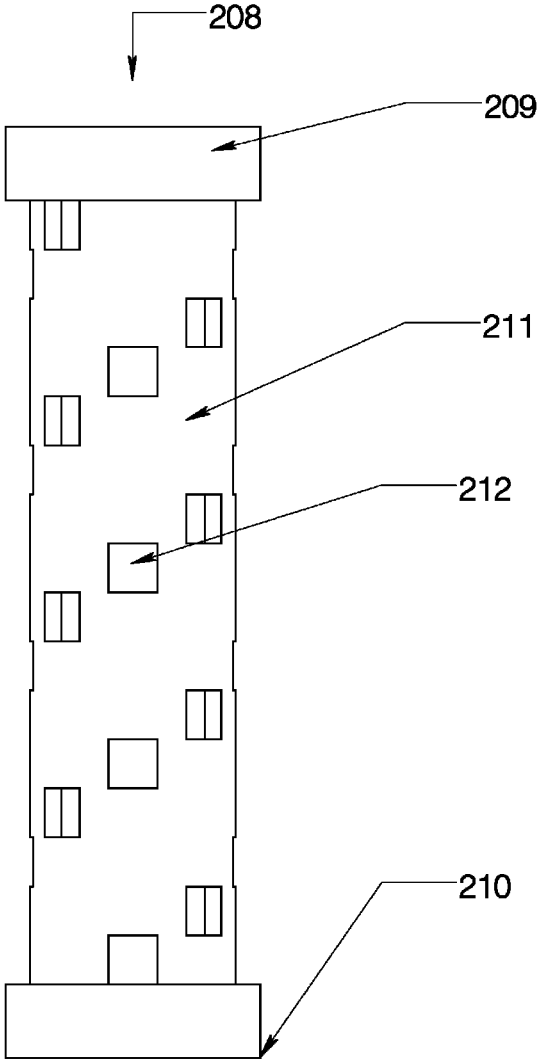

FIG. 32 illustrates a cam housing 208 that is placed around the pinion 205 and cams 206. The cam housing 208 comprises a distal housing end cap 209, a mounting base end cap 210, a main housing body 211, and one or more guide ports 212 which are oriented along the main housing body, through which one or more dilator rings 213 (not shown in FIG. 32, see FIG. 34) may be placed. The cam housing may be secured to the dilator device 200 such that some or all of the inner cams 206 are fully or partially enclosed. The cam housing may be secured to the dilator device through the distal housing end cap and mounting base end cap by any conventional means known to one of ordinary skill such as a threaded fastener, interference fit, locking mechanism or the like. The cam housing 208 provides a rigid support structure through the length of the device and provides support and guidance for the dilator rings 213. The cam housing 208 is preferably a rigid piece made of any medically acceptable or FDA approved material, preferably an FDA approved plastic material.

Figure 34:
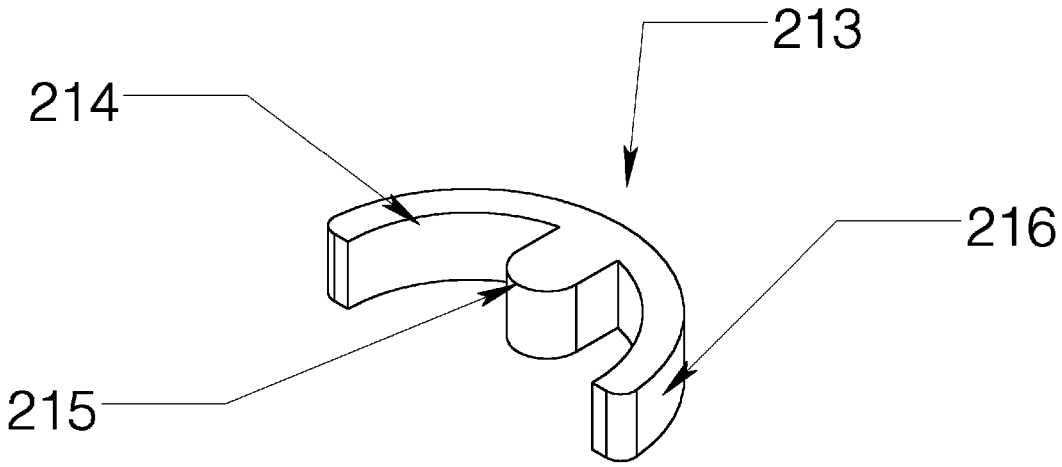
FIGS. 34-35 show a dilator ring according to a second embodiment of the invention.
Figure 35:
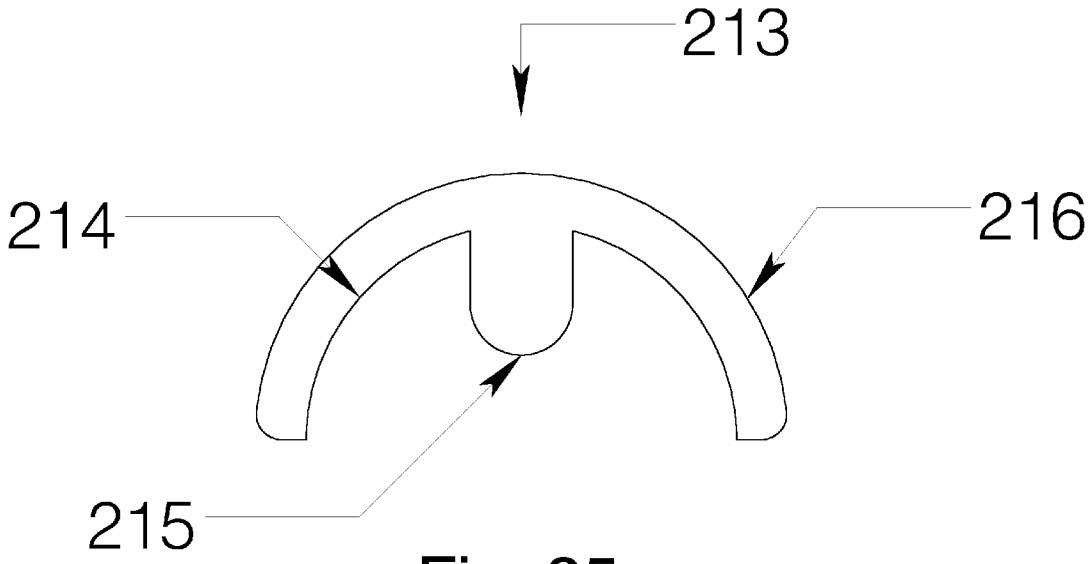

FIGS. 34-35 show one implementation of the dilator ring 213. The dilator ring comprises a cam housing mating surface 214, a cam contacting follower shaft 215, and a flexible covering mating surface 216. As shown in the figures, the dilator ring is a generally C shaped ring with an outer surface and an inner surface, and a protrusion along the inner surface such that the C shaped ring resembles the letter "E". The cam contacting follower shaft 215 corresponds to this protrusion, whereas the inner surface corresponds to the cam housing mating surface 214 and the outer surface corresponds to the flexible covering mating surface 216. The cam contacting follower shaft 215 is preferably inserted into the one of the one or more guide ports 212 which are oriented along the main housing body of the cam housing 208 such that the flexible covering mating surface 216 faces outwards and the cam housing mating surface 214 faces the cam housing. It should be understood that variations of the shape of the dilator ring 213 are intended to be included within the scope of the invention.

Figure 36:
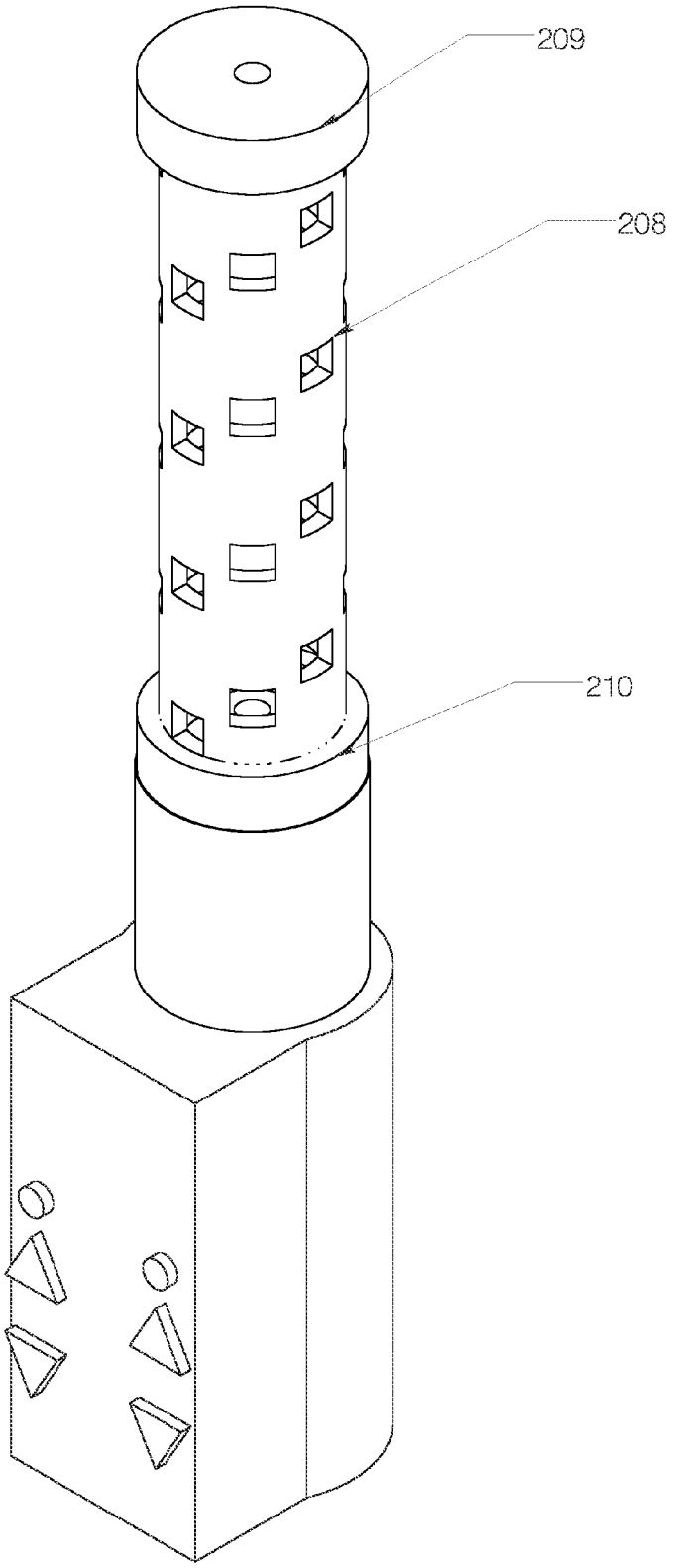
FIGS. 36-37 are a perspective and side view of a second embodiment of the invention, showing the cam housing installed on the dilator device.
Figure 37:
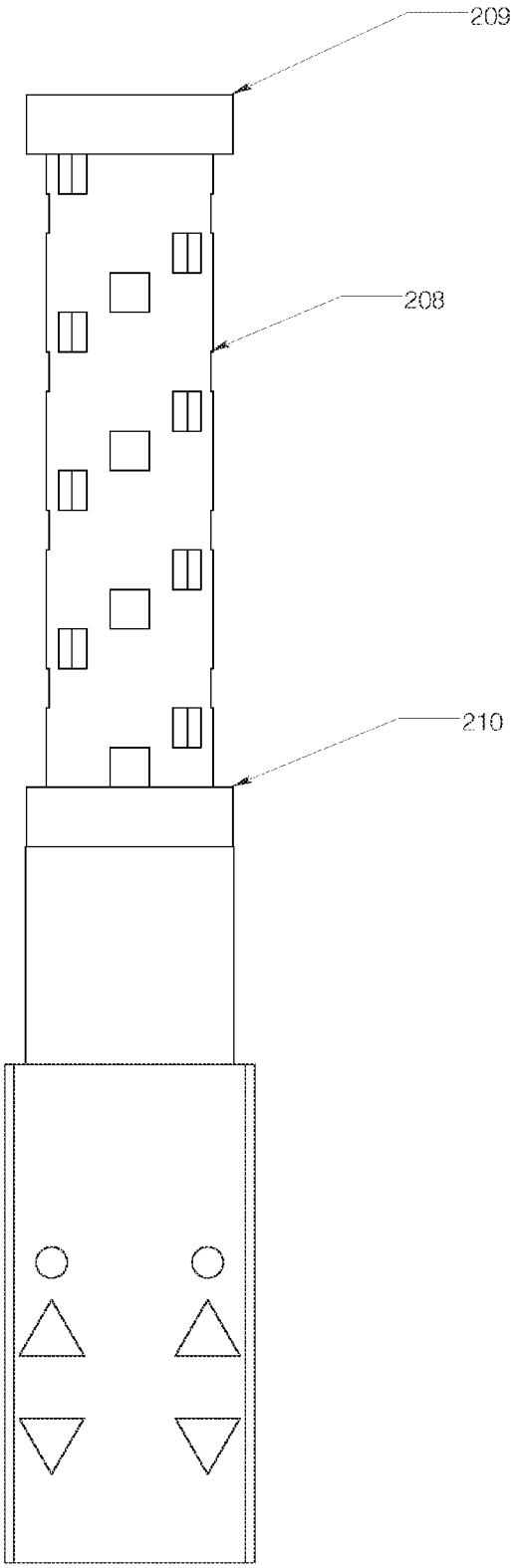

FIGS. 36-37 are perspective and side views, respectively, showing the cam housing installed on the dilator device and covering the pinion shaft and cams. As explained above, the dilator rings are mounted to the cam housing by passing the follower shaft 215 through the guide ports 212, which provides the configuration illustrated in FIGS. 38-41.

Figure 38:
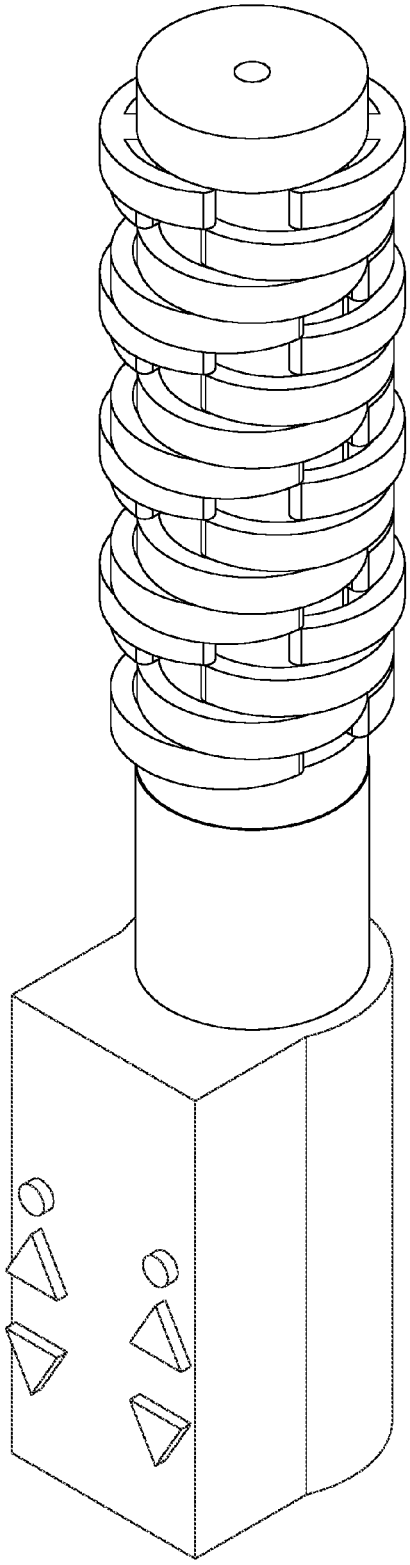
FIGS. 38-39 are a perspective and side view of a second embodiment of the invention, showing the dilator rings in a dilated state.
Figure 39:
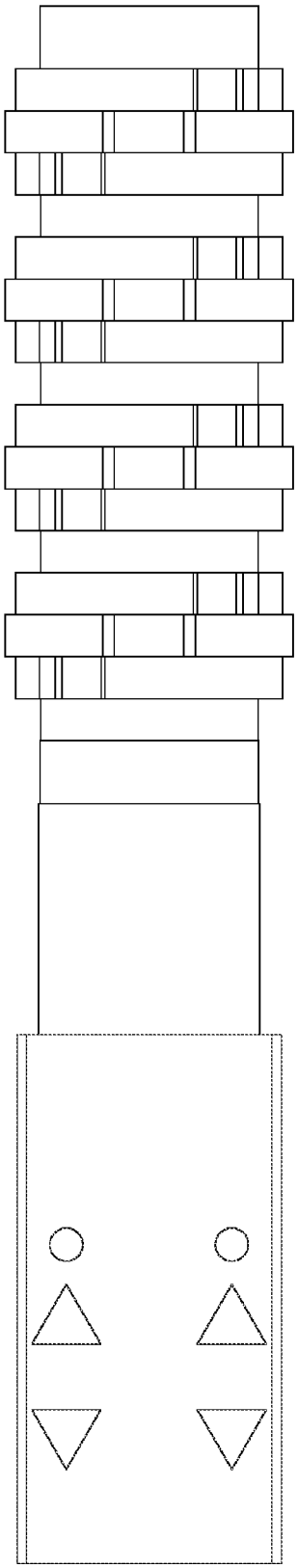
Figure 40:
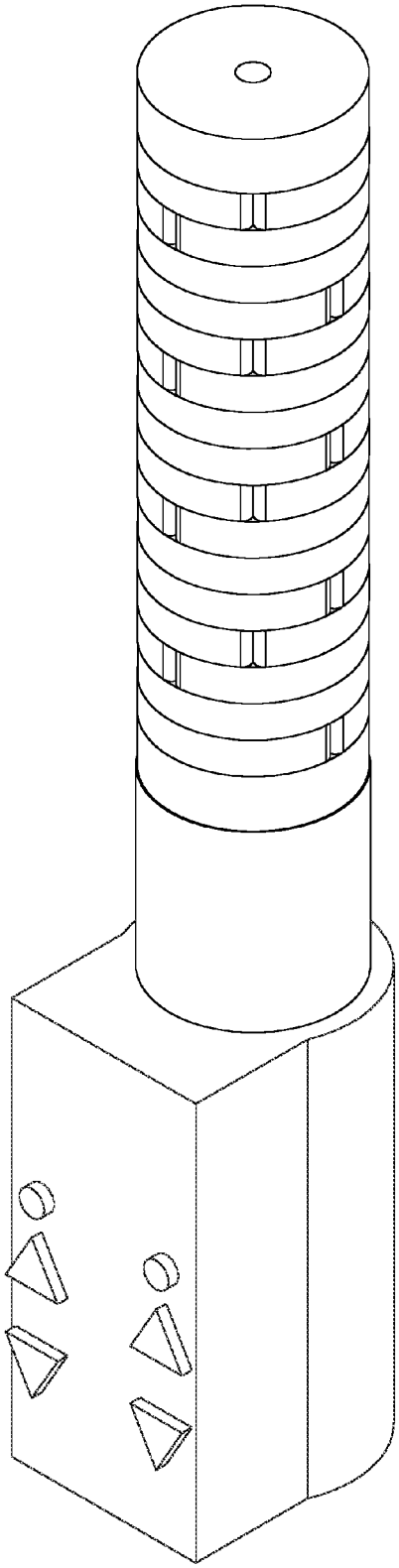
FIGS. 40-41 are a perspective and side view of a second embodiment of the invention, showing the dilator rings in a contracted state.
Figure 41:
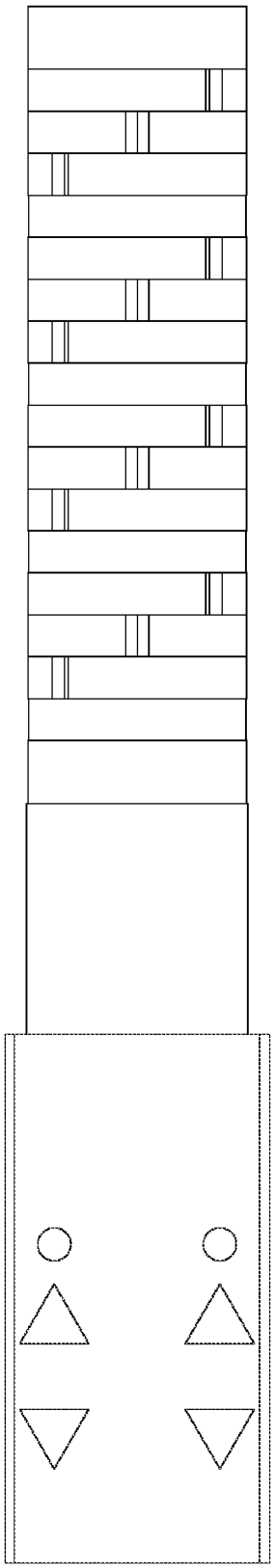

In use, the user selects the desired user control setting, e.g. vibratation, from the control section 241 which then starts the cam drive pinion shaft 205 to rotate or turn. As the shaft turns, a number of inner cams 206*a-p* are also rotated. As shown in FIG. 29, these cams are placed in a stacked manner with each cam oriented approximately 45 degrees relative to adjacent cams. It should be noted, however, that adjacent cams may have a varied orientation along the length of the came drive pinion shaft, and that the cams may be offset from each other by 1 degree up to 359 degrees. Each cam may be identical or different in shape, size and/or design. The cam housing is positioned over the cam drive pinion shaft and inner cam assembly. The guide ports 212 of the cam housing are designed to mate with the cam contacting follower shaft 215 of each dilator ring 213. When the cam housing and dilator rings are in place, each inner cam is designed to push against the cam contacting follower shaft of each dilator ring as the inner cams rotate. When an inner cam is oriented in a manner which causes it to push outwardly against the cam contacting follower shaft, it causes the dilator ring to be in an expanded or dilated state. As the inner cams continue to rotate, the shape of the inner cam is such that pressure will be relieved from the cam contacting follower shaft allowing the cam to move inwardly towards the cam housing. When this occurs, the dilator ring is in a contracted state. As the cam drive pinion shaft is rotated, this action and reaction between the inner cam and cam contacting follower shaft is repeated indefinitely until the user selects a different setting, such as a "vibration" setting or the "off" setting. The motion that results from these components is a smooth and rhythmic motion and can either run the full length of the device, or be concentrated on portions of the device. The dilator rings in a dilated or expanded state are shown in FIGS. 38 and 39. The dilator rings in a contracted are shown in FIGS. 40 and 41.

The cam housing 208 may be manufactured to be easily removable such that a user may secure different cam housings to the dilator device 200. In one aspect of the invention, several cam housings may be interchangeably used in conjunction with the dilator device. The cam housings may differ in terms of shape, length, radius, width, length and/or orientation of guide ports 212 on the surface of the main housing body 211. The ability of the dilator device 200 to have interchangeable cam housings 208 allows the user to vary the arrangement of inner cams and dilator rings, which also varies the type of massage/dilation therapy being provided by the device. This is especially important to customize the therapy needed or type of massage desired by the user. The U shaped muscles of the vaginal walls and doughnut shaped muscles of the anal sphincter each require a slightly different arrangement. These differently shaped orifices can be accommodated by the interchangeability of the cam housing, which allows for easy rearrangement of the dilator rings and thus places pressure in certain areas while keeping other areas contracted.

In one embodiment, one or more dilator rings may move rhythmically from a contracted to dilated state only on a portion of the outer circumference of the device while maintaining rigidity on the remaining area of the device. In another embodiment, a portion of the device may be changing from a contracted to dilated state while the remaining area is rigid or vibrating.

The design described in the second embodiment of the present invention is a clear improvement over prior art sexual stimulation devices, which are not designed to allow for easy rearrangement of parts in order to adjust the therapy or stimulation being given. For example, U.S. Pat. No. 7,828,717 discloses a mechanized dildo having outer cams along the length of the device which are held together using long rods through which the cams must be slid in order to be correctly positioned on the device. These cams are not easily removable because two rods which hold the cams in place must also be removed. Furthermore, the removal of such rods likely results in other components of the dildo becoming unfastened and therefore it is not optimal for varying the type of stimulation. Therefore, there can be no tailoring of stimulation or therapy in the manner that the present invention is designed to achieve. It is the nature of the cam housing 208, dilator rings 213, and inner cams 206 which allow for customization of the arrangement of dilator rings along the circumference of the device and accommodation of specific patient/user needs.

The design of the present invention also allows for ease of manufacturing and assembly of parts when compared to prior art dildos. For example, the '717 patent requires a great number of guide rods, with each rod needing to slidably mate within slots in each outer piece in order for the outer pieces to be secured to the device. The present invention instead utilizes a single rigid housing having one or more guide ports 212 through which one or more dilator rings can easily fit into as is described above. These are large pieces which require minimal assembly in comparison to the guide rod and slot concept of the '717 patent.

In another embodiment, the entire upper assembly may be interchangeable with other similar assemblies having a base motor. The upper assembly may include the cam drive pinion shaft, inner cams, dilator rings, and the outer flexible covering of the device. This upper assembly may be secured and removed to a base motor assembly by any conventional means, such as a rotating snap in place mating plate. This design would allow patients and medical practitioners to exchange the upper assembly and vary the therapeutic effect as a patient's needs progress and adjust.

In another embodiment, a heating element may be incorporated into the dilator device 200, such as a heating wire. Incorporating a heating element into the dilator device allows the device to be heated to the patient's preference such that the temperature of internal tissues of the bodily orifice is maintained, thus promoting the relaxed state of the patient of the device and encouraging the gradual expansion of the orifice being treated. The temperature of the heating wire may be controlled by the patient or may be kept at a predetermined optimal temperature. The temperature may be set such that the insertion section of the device is from 95° to 110° F. and is preferably set to 104° F.

Figure 42:
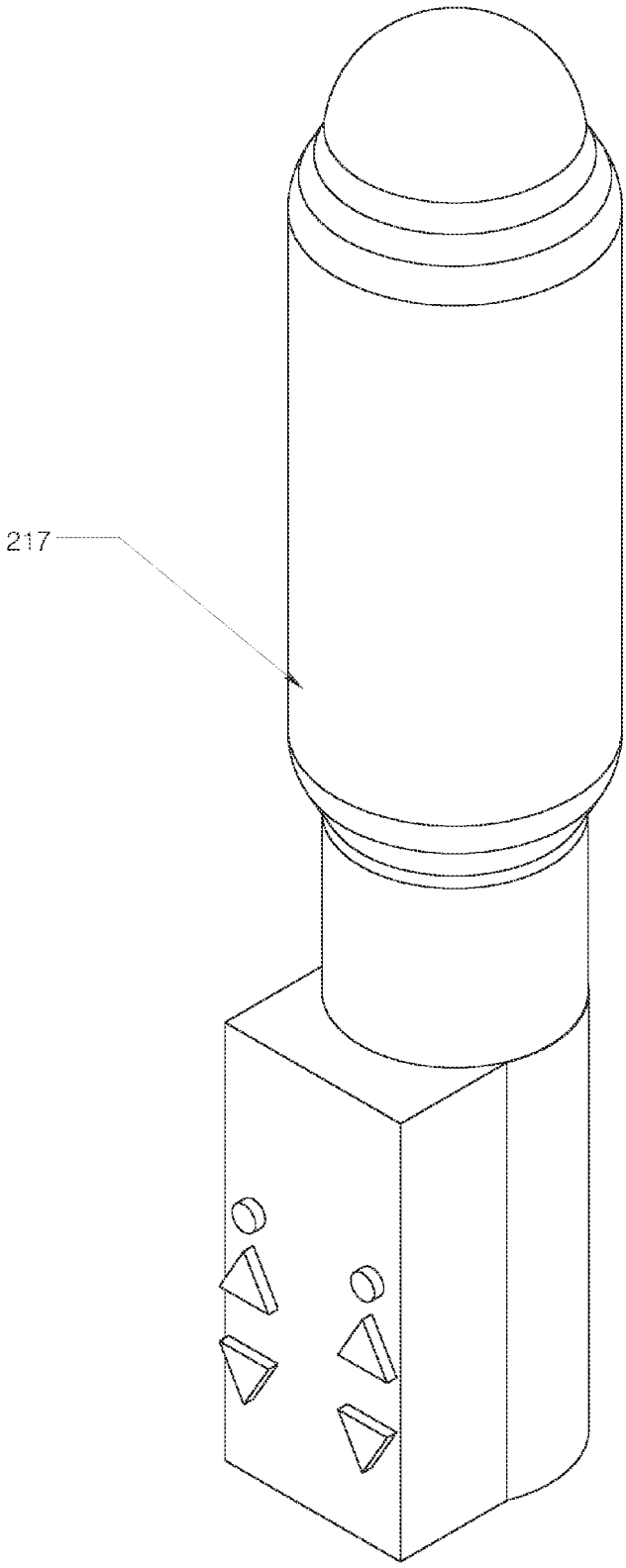
FIG. 42 is a perspective view of the dilator device according to a second embodiment of the invention which has an outer covering, the device being in the dilated state.
Figure 43:
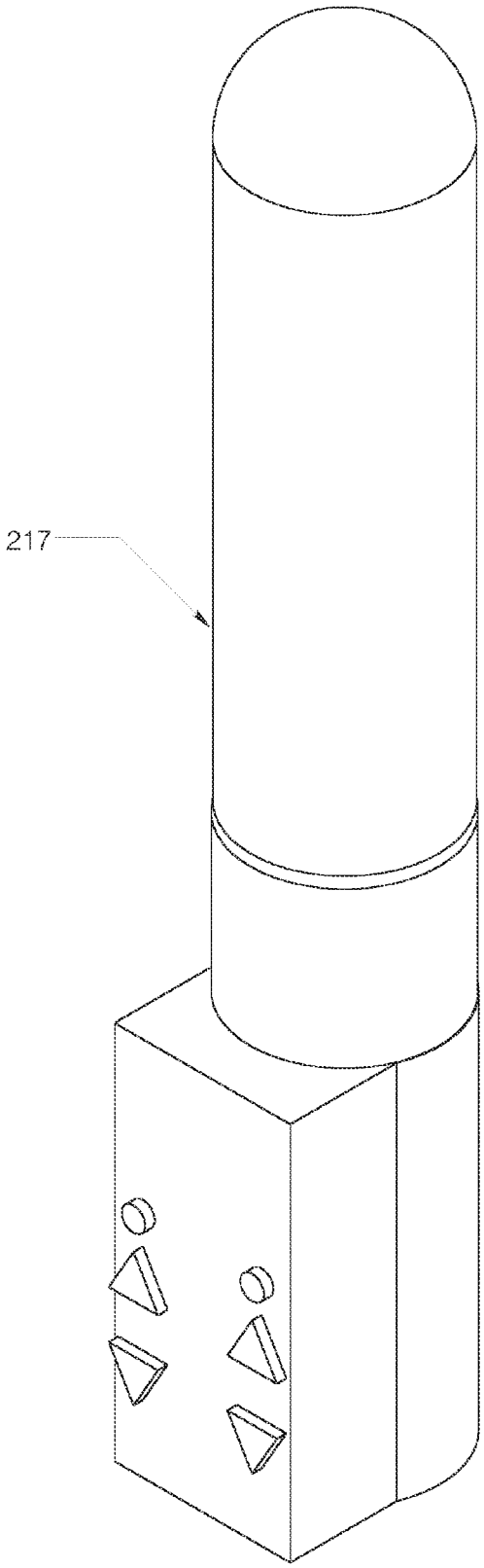
FIG. 43 is a perspective view of the dilator device according to a second embodiment of the invention which has an outer covering, the device being in the contracted state.

FIGS. 42 and 43 show the dilator device 200 having a flexible covering 217 which may be secured to the outer surface of the cam housing 208. The covering 217 may be made from any medically acceptable or FDA approved material for tissue contact use. In one embodiment, the covering 217 is made of a silicon rubber material. It should be understood that a variety of materials may be used for the covering and the invention is not limited by the choice of these materials. FIG. 42 illustrates the covering 217 in an expanded or dilated state, e.g., the dilator rings are pushed outward. FIG. 43 illustrates the covering 217 in a contracted state, e.g., the dilator rings are recessed inward against the cam housing. The flexible covering 217 has elastic properties against which the cams and dilator rings must push to expand outward to the dilated state. This same elastic property causes the dilator rings to recess inward when the pinion shaft is in a position such that the cams are in contracted states that allows the dilator rings to move inward.

As previously stated, the device of this invention may be used for medical purposes and/or sexual pleasure purposes because of its ability to dilate and contract along the length of the device. Additionally, the ability of the cams and rings of the device to have varied orientations also allows the device to be used to provide internal massaging to the areas of the vagina, anus or other internal orifice of the body.

As stated with respect to FIGS. 21-24, the insertion section 140 of the dilator device 100 is the portion of the dilator device which may be inserted into the orifice to be treated while the control section 141 of the device may be held by the patient to manipulate various features of the device. The control section 141 may be attached to the insertion section 140 to form a single unit, as shown in the figures. The control section 141 may be designed such that the patient can conveniently control various settings or adjust the placement of the dilator device in an ergonomic manner without the need to move into uncomfortable positions to reach for the device. In one preferred embodiment, the control section is separated from the insertion section by a flexible gooseneck which may be manipulated by the user to adjust the positioning of the insertion section inside or immediately outside of the orifice being treated. This enables the device to have versatility in terms of treatment options and adjusting treatment regimen depending on the patient's progress through continued use of the device.

Figure 44:
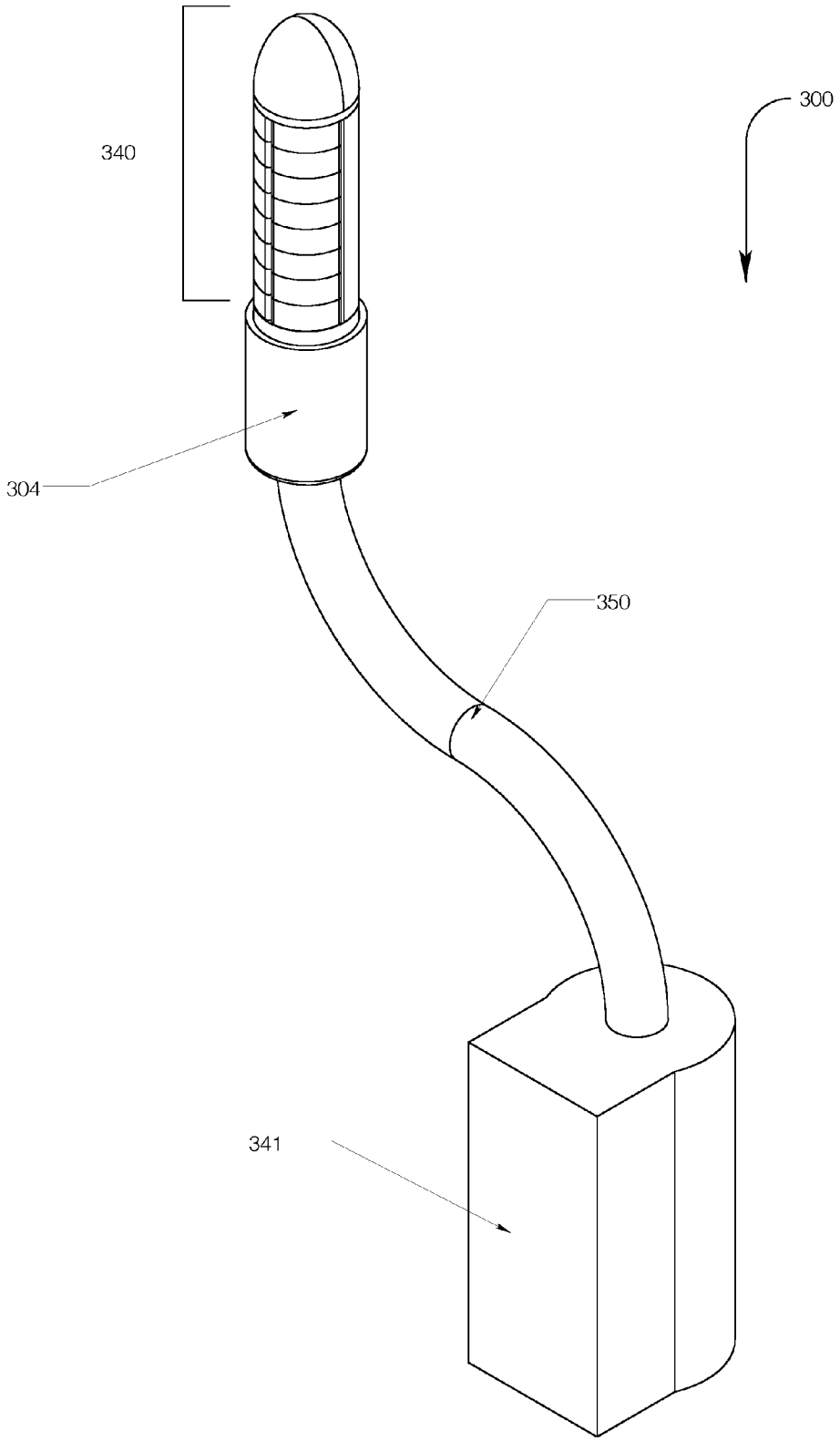
FIGS. 44-45 are perspective views of a third embodiment of the invention, showing the dilator device with a flexible gooseneck.

FIG. 44 illustrates this preferred embodiment as dilator device 300 having insertion section 340, control section 341, and flexible gooseneck 350. The flexible gooseneck 350 may be a hollow shaft made of metal, plastic and/or rubber material. In one embodiment, the flexible gooseneck is made up of an extrudable plastic material, such as flexible PVC. In another embodiment, the flexible gooseneck 350 is a flexible steel bar with a latex covering. It should be understood that a variety of materials may be used for the construction of the flexible gooseneck and covering and the invention is not limited by the choice of these materials. In one embodiment, the covering for the flexible gooseneck is made of a silicon rubber material.

FIG. 44 shows the motor housing 304 being placed at the lower end of the insertion section 340. It should be understood that the internal mechanism for the dilator device 300, shown in FIGS. 44-46, comprises a central drive axis comprising a cam drive pinion shaft, an AC or DC motor housing 304 where the cam drive pinion shaft 305 may be rotated in the same manner as the dilator arm drive pinion 105 in the first embodiment of the invention and as explained in connection with FIGS. 1 and 2. That is, the dilator device 300 may have all or some of the components which function to enable the cam drive pinion shaft to rotate as is explained in connection with FIGS. 1 and 2. In particular with respect to FIG. 44 is that the motor housing 304 is in electrical connection with the control section 341 using wires which run through the hollow flexible gooseneck. In this embodiment, the cam drive pinion shaft 305 shown in detail in FIG. 46 may be rotated upon the user selecting the desired control setting on the control section 341 which then starts the cam drive pinion shaft 305 to rotate or turn. Just as described with respect to FIGS. 27-43, as the shaft turns, a number of inner cams are also rotated.

The guide ports 312 of the cam housing are designed to mate with the cam contacting follower shaft 315 of each dilator ring 313. When the cam housing and dilator rings are in place, each inner cam is designed to push against the cam contacting follower shaft of each dilator ring as the inner cams rotate. When an inner cam is oriented in a manner which causes it to push outwardly against the cam contacting follower shaft, it causes the dilator ring to be in an expanded or dilated state. As the inner cams continue to rotate, the shape of the inner cam is such that pressure will be relieved from the cam contacting follower shaft allowing the cam to move inwardly towards the cam housing. When this occurs, the dilator ring is in a contracted state. As the cam drive pinion shaft 305 is rotated, this action and reaction between the inner cam and cam contacting follower shaft is repeated indefinitely until the user selects a different setting, such as a "vibration" setting or the "off" setting. Thus, dilator device 300 changes from an expanded to contracted state in the same manner as has been described with respect to dilator device 200, but contains an additional feature that the dilator device 300 contains a flexible gooseneck 350 connecting the insertion section to the control section which allows the user to manipulate the angle or manner in which the insertion section is placed within the orifice being treated. For example, the flexible gooseneck could be manipulated into a U-shape or S-shape to compliment the user's particular anatomy or to help with the treatment of a particular condition.

The flexible gooseneck may be attached to the motor housing 304 and/or control section 341 in a number of ways, such as press fitting or screw fitting such that the motor housing and control section each include threading designed to mate with the flexible gooseneck threading. The components may also be joined by any conventional means, such as using a threaded screw. The flexible shaft in one embodiment is designed to be an interchangeable component such that a variety of shafts having varying characteristics may be used. For example, the shafts used in connection with the device 300 may vary in terms of diameter, length, flexibility and material.

The length of the gooseneck is approximately between 1-20 inches, more preferably between 5-15 inches, and most preferably between 6-12 inches. The flexible gooseneck preferably has a diameter that is less than the insertion portion of the device, as is shown in the Figures.

Figure 45:
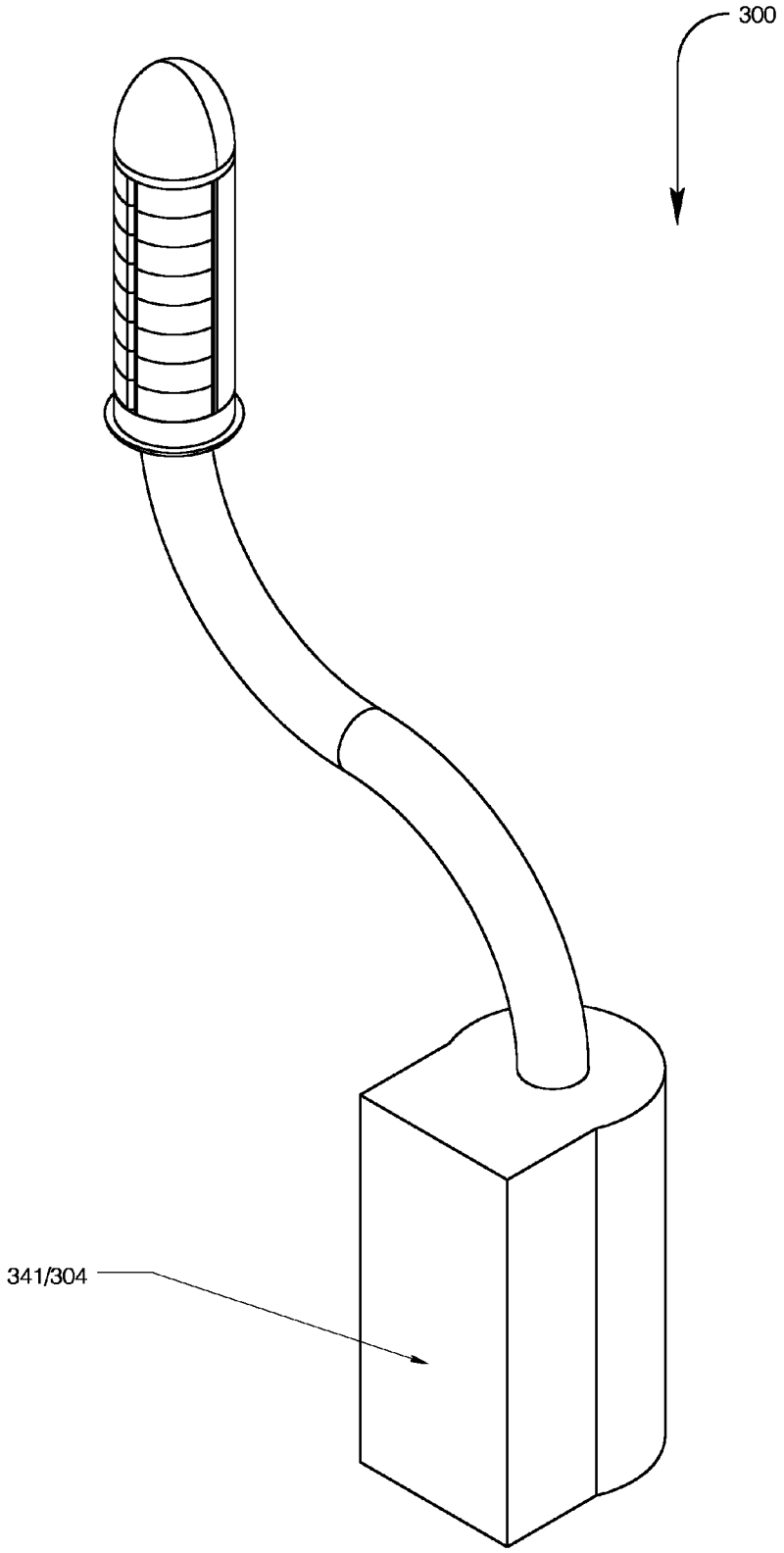
Figure 46:
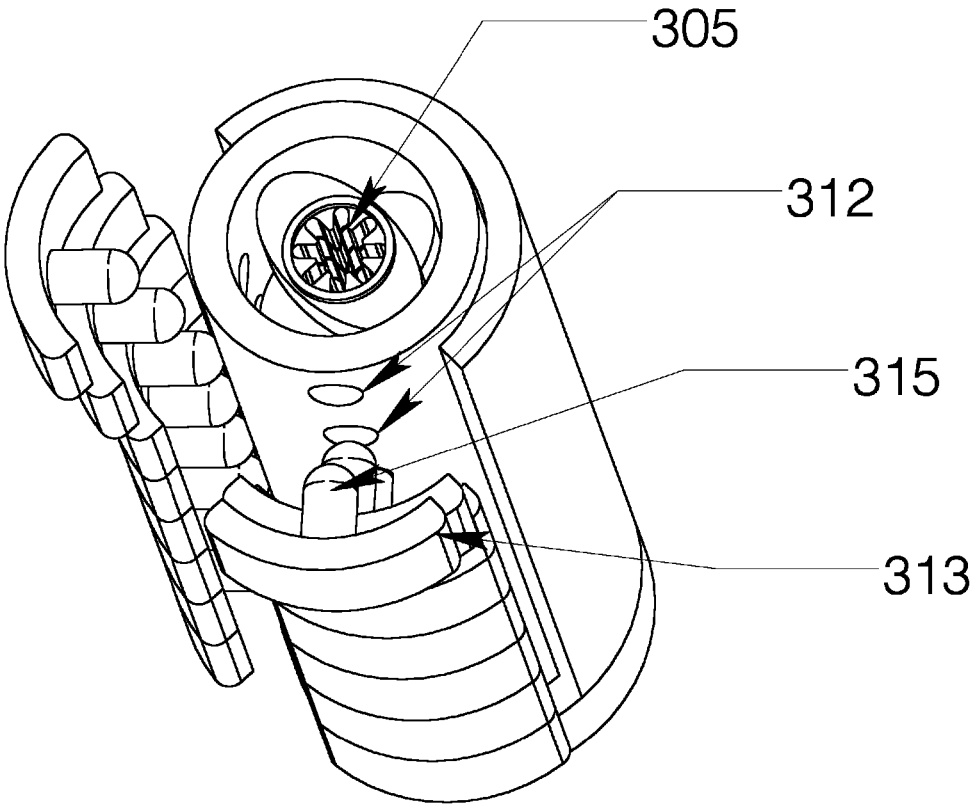
FIG. 46 is an exploded view of the second and third embodiments of the invention showing the mating of the dilator rings with the cam housing.

FIG. 45 illustrates an embodiment of the dilator device, 300, with the motor 304 contained within the control section 341. In this embodiment, the cam drive pinion shaft is a flexible drive shaft which runs along the length of the gooseneck. In another embodiment, wires may be run through the flexible gooseneck which electrically connect between the motor and the cam drive pinion shaft 305 such that the cam drive pinion shaft 305 is rotated when the motor is activated by the user through the control section 341. Having the motor contained within the control section 341 provides a number of benefits, such as enabling the insertion portion to be lighter in weight which prevents a downward force from being exerted by the device when it is inserted into the orifice being treated. This placement of the motor also enables the device to have a more desirable aesthetic appearance, to maintain a shorter length of the functional end, and increases the comfort of the user by not providing a hindrance or stopping point along the length of the insertion section 340.

In one embodiment, a heating element may be incorporated into the insertion section 340 of the dilator device 300. The heating element may be a wire designed to fit within a channel carved into the cam housing. The heating element of dilator device 300 would be electrically connected to the control section 341 by running through the interior of the flexible gooseneck 350. Incorporating a heating element into the dilator device allows the device to be heated to the patient's preference such that the temperature of internal tissues of the bodily orifice is maintained, thus promoting the relaxed state of the patient and encouraging the gradual expansion of the orifice being treated. The temperature of the heating wire 130 may be controlled by the patient or may be kept at a predetermined optimal temperature.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

What is claimed is:

1. A therapeutic device comprising:

a motor unit operatively engaged to a rotatable drive shaft;

an insertion section comprising:

a plurality of axially spaced inner cams rotationally coupled to the drive shaft;

a generally cylindrical housing encircling the inner cams, the housing comprising a plurality of guide ports;

a plurality of dilator rings surrounding the housing, each of the dilator rings including a follower shaft slidably engaged in one of the plurality of guide ports; and a flexible covering surrounding the dilator rings; and a control unit for operating the motor unit.

2. The device of claim 1, wherein the inner cams rotate in response to rotation of the drive shaft.

3. The device of claim 1, wherein the control unit is operative for adjusting the extent of expansion and contraction of the device.

4. The device of claim 1, wherein the control unit is operative for changing speeds of rotation of the drive shaft and vibration independently in response to separate operator-controlled elements.

5. The device of claim 1, wherein at least one of the plurality of dilator rings is moved radially in response to a force exerted by at least one of the plurality of inner cams as the inner cams rotate in response to rotation of the drive shaft.

6. The device of claim 5, wherein the plurality of dilator rings are moved radially in response to a force exerted by the plurality of inner cams as the plurality of inner cams rotate in response to rotation of the drive shaft.

7. The device of claim 1, further comprising a flexible neck having a proximal end and a distal end, the proximal end being in connection with the control unit and the distal end being in connection with the insertion section.

8. The device of claim 1, wherein the motor unit is housed within the control unit.

9. The device of claim 1, further comprising a heating element.

10. The device of claim 1, wherein:

each follower shaft is slidably engaged in one of the plurality of guide ports such that each follower shaft is in contact with one of the plurality of inner cams; and the motor unit rotates the drive shaft and the plurality inner cams such that the inner cams engage with the follower shafts causing the plurality of dilator rings to move relative to the drive shaft and expand and contract the flexible covering.

11. A method of treating an orifice of the body, the method comprising:

providing a therapeutic device comprising:

a motor unit operatively engaged to a rotatable drive shaft;

an insertion section comprising:

a plurality of axially spaced inner cams rotationally coupled to the drive shaft;

a generally cylindrical housing encircling the inner cams, the housing comprising a plurality of guide ports;

a plurality of dilator rings surrounding the housing, each of the dilator rings including a follower shaft slidably engaged in one of the plurality of guide ports; and a flexible covering surrounding the dilator rings; and a control unit for operating the motor unit;

inserting the insertion section into the orifice of the body;

activating the device to adjust the extent of expansion and contraction of the insertion section.

12. The method of claim 11, wherein the inner cams rotate in response to rotation of the drive shaft.

13. The method of claim 11, wherein the therapeutic device further comprises a flexible neck connecting the control unit and the insertion unit and the method further comprises adjusting the position of the insertion section inside or immediately outside of the orifice being treated using the flexible neck.

14. The method of claim 11, wherein the control unit is operative for changing speeds of rotation of the drive shaft and vibration independently in response to separate operator-controlled elements.

15. The method of claim 11, wherein at least one of the plurality of dilator rings is moved radially in response to a force exerted by at least one of the plurality of inner cams as the inner cams rotate in response to rotation of the drive shaft.

16. The method of claim 15, wherein the plurality of dilator rings are moved radially in response to a force exerted by the plurality of inner cams as the plurality of inner cams rotate in response to rotation of the drive shaft.

17. The method of claim 11, further comprising a flexible neck having a proximal end and a distal end, the proximal end being in connection with the control unit and the distal end being in connection with the insertion section.

18. The method of claim 11, wherein the motor unit is housed within the control unit.

19. The method of claim 11, wherein the therapeutic device further comprises a heating element.

20. The method of claim 11, wherein:

each follower shaft is slidably engaged in one of the plurality of guide ports such that each follower shaft is in contact with one of the plurality of inner cams; and the motor unit rotates the drive shaft and the plurality inner cams such that the inner cams engage with the follower shafts causing the plurality of dilator rings to move relative to the drive shaft and expand and contract the flexible covering.

* * * * *

UNITED STATES PATENT AND TRADEMARK OFFICE

CERTIFICATE OF CORRECTION

PATENT NO. : 9,066,843 B1
APPLICATION NO. : 13/767298
DATED : June 30, 2015
INVENTOR(S) : Darren J. Greco et al.

It is certified that error appears in the above-identified patent and that said Letters Patent is hereby corrected as shown below:

On the title page, item 75, as an inventor, please add --Betsy Greenleaf, Clarksburg, NJ (US)--.

Signed and Sealed this
Twenty-third Day of August, 2016

Michelle K. Lee

Michelle K. Lee
*Director of the United States Patent and Trademark Office*